US005396932A

United States Patent [19]

Homma et al.

[11] Patent Number: 5,396,932

[45] Date of Patent: Mar. 14, 1995

[54] CARBON FIBER WOVEN FABRIC, ITS WEAVING METHOD AND WEAVING APPARATUS

[75] Inventors: Kiyoshi Homma, Oumihachiman; Akira Nishimura; Ikuo Horibe, both of Ehime, all of Japan

[73] Assignee: Toray Industries, Inc., Tokyo, Japan

[21] Appl. No.: 123,156

[22] Filed: Sep. 7, 1993

[30] Foreign Application Priority Data

Sep. 8, 1992 [JP] Japan ..... 4-239224
Apr. 5, 1993 [JP] Japan ..... 5-077967

[51] Int. Cl.[6] ..... D03D 3/00; D03D 15/00; B32B 9/00

[52] U.S. Cl. ..... 139/420 A; 139/426 R; 428/225; 428/229; 428/408; 428/902

[58] Field of Search ..... 428/225, 367, 375, 229, 428/395, 408, 902; 264/174, DIG. 29; 427/394; 139/420 A, 426 R

[56] References Cited

U.S. PATENT DOCUMENTS 4,320,160 3/1982 Nishimura et al. ..... 428/107
4,986,316 1/1991 Morohashi et al. ..... 139/452
5,021,283 6/1991 Takenaka et al. ..... 428/116
5,118,569 6/1992 Kuroda et al. ..... 428/367

FOREIGN PATENT DOCUMENTS 538079 5/1955 Belgium .
2715046 10/1977 Germany .
58-191244 11/1983 Japan .
274645 3/1990 Japan .
513264 11/1971 Switzerland .

OTHER PUBLICATIONS

Database WPI, Week 8350, Derwent Publ. Ltd. AN 83-842088 & JP-A-58 191 244.
Database WPI, Week 9017, Derwent Publ. Ltd. AN 90-127431 & JP-A-2 074 645.

*Primary Examiner*—George F. Lesmes
*Assistant Examiner*—Kathryne E. Shelborne

[57] ABSTRACT

A carbon fiber woven fabric which uses a flat carbon fiber yarn consisting of many carbon fibers as at least its warp or weft, its weaving method and weaving apparatus. The flat carbon fiber yarn is twist-free, the number of its carbon fibers being 6,000 to 36,000, the yarn size being 3,000 to 30,000 deniers, the yarn width being 4 to 16 mm, the yarn thickness being 0.07 to 0.6 mm, and the ratio of yarn width to yarn thickness being 20 to 150. In the carbon fiber woven fabric, the flat carbon fiber yarn has a yarn width of 4 to 16 mm, a yarn thickness of 0.07 to 0.6 mm, a ratio of yarn width to yarn thickness of 20 to 150, and a ratio of weaving yarn pitch to yarn width of 1.0 to 1.2, the thickness of the woven fabric being 0.1 to 0.6 mm, the weight of woven fabric being 90 to 500 g/m$^2$ and the fiber density of woven fabric being 0.8 to 1.2 g/cm$^3$. The woven fabric is woven by a weaving apparatus provided with at least a weft supply device or a warp supply device.

7 Claims, 7 Drawing Sheets

CARBON FIBER WOVEN FABRIC, ITS WEAVING METHOD AND WEAVING APPARATUS

BACKGROUND OF THE INVENTION

1. Field of the Invention

The present invention relates to a carbon fiber woven fabric made of flat carbon fiber yarn, which exhibits excellent characteristics as a fiber composite material, its weaving method and weaving apparatus, and more particularly to a thin carbon fiber woven fabric, which uses flat carbon fiber yarn and which features uniform fiber density, its weaving method and weaving apparatus.

2. Description of Related Arts

The carbon fiber woven fabric, which is made of carbon fibers having high specific Young's modulus and high specific strength, is normally woven by a general shuttle loom or rapier loom. Such carbon fiber woven fabric is frequently used as a reinforcing base fabric for composite materials including carbon fiber reinforced plastic (hereinafter referred to as "CFRP") by compounding it with a matrix resin and molding them into a specific shape.

As a composite material using such a reinforcing base fabric, the CFRP, for example, is starting to be used as a structural material or the like for aircraft owing to its excellent performance. To further expand the application field of the CFRP, it is important to reduce the cost of the molding and also of the carbon fiber and the reinforcing base fabric for carbon fiber woven fabric (hereinafter referred to as "CF fabric").

The carbon fiber yarn (hereinafter referred to as "CF yarn") can be manufactured with higher productivity in the precursor, oxidation process, and carbonization process and at lower cost as the yarn size increases.

A typical CF fabric, however, is made of CF yarn which coheres to have a nearly round cross section; therefore, in a woven state, the cross section of the CF yarn at a point at which the warp and weft cross each other is elliptic, with the weaving yarn being significantly crimped. This trend is conspicuous especially in a CF fabric which uses CF yarn with a largre yarn size because warp and weft of a large yarn size cross each other.

Hence, in the CF fabric with considerably crimped CF yarn, the fiber density tends to be nonuniform, preventing high strength, which is a feature of carbon fiber, from being fully exhibited. In addition, the CF fabric using CF yarn with a large yarn size is normally accompanied by more weight of woven fabric (g/m$^2$) and increased thickness. This adversely affects the resin infiltration property when manufacturing a preimpregnated material (hereinafter referred to simply as "prepreg"), or molding a fiber reinforced plastic (hereinafter referred to as "FRP").

Therefore, CFRP produced by using a CF fabric woven with CF yarn with a large yarn size inevitably has more voids present in the resin, failing to exhibit high strength.

On the other hand, in the case of a CF fabric which is woven with CF yarn of a large yarn size and which has a smaller weight of woven fabric, the gaps formed between CF yarns are larger. For this reason, forming CFRP using the CF fabric with a smaller weight of woven fabric presented a disadvantage in that the CF yarn content is low and resin voids occur intensively in the gaps which are formed between the CF yarns, thus making it impossible to acquire a high-performance CFRP.

Unexamined Japanese Patent Publication (KOKAI) No. 58-191244 discloses a thin woven fabric, which uses a thin, wide and flat CF yarn, and has a thickness of 0.09 mm or less and a weight of woven fabric of 85 g/m$^2$ or less, and its weaving method which eliminate the disadvantage described above. Since this thin woven fabric is extremely thin, the crimps of the weaving yarn are small; therefore, high reinforcing effect is ensured, making it a good basic fabric for molding a thin CFRP.

The CF fabric using such a flat CF yarn is woven by successively shedding, by a heald, a warp supplied from a beam wound with the required number of CF yarns or a sheet-like warp supplied from a CF yarn bobbin which is mounted on a creel, and by intermittently inserting weft into the open sheds using a shuttle or rapier.

In this case, the warp is supplied through a beam or directly from a bobbin as described above. In either way, there are two methods; one is the transverse take-out wherein the warp is taken out, while slowly turning the CF yarn bobbin, by pulling it out in a direction so that it crosses with the rotary axis at right angle, and the other is the longitudinal take-out wherein the warp is taken out by pulling it out in a direction of the axis of the bobbin.

Since the warp is paid out in the direction of the axis of the bobbin in the longitudinal take-out, this method is more advantageous than the transverse take-out in that the warp can be paid out instantly at high speed without drag. In the longitudinal take-out, however, the warp is twisted once each time the warp is paid out from the bobbin. Thus, the flatness of the warp at the twisted portion is crushed and partially squeezed. This presents a problem in which a CF fabric with a uniform warp yarn width cannot be obtained.

To solve such a problem, a weaving method can be considered whereby to prevent the warp from being twisted by using the transverse take-out instead. In a conventional heald, however, the mail is made to be longer than it is wide in order to minimize the chance of interference with warp. This causes the mail or the comb, which makes warp density uniform, to crush the flatness of warp, and a fabric with uniform yarn width throughout the fabric cannot be produced.

On the other hand, the weft must be quickly supplied to the above-mentioned open sheds; therefore, the weft supplying speed needs to be higher than that of the warp. Hence, to quickly take out the weft from the fiber yarn bobbin, the longitudinal take-out, whereby the weft is paid out in the direction of the axis of the fiber yarn bobbin, is widely used. This, however, presents a problem in that the yarn is twisted.

To solve such a problem, in Unexamined Japanese Patent Publication No. 2-74645, a method, wherein a bobbin with weft wound around it is actively rotated by a motor and the weft in a length required for inserting it is retained making use of gravity, is suggested.

However, this method wherein the bobbin is actively rotated presents a problem in that the take-out speed must be changed according to the amount of weft wound round the bobbin. In addition, the motor is intermittently run in accordance with the insertion of weft, and therefore, the motor is started and stopped frequently, causing the flat CF yarn to be slackened and thus twisted due especially to the lag in the stopping motion.

Further, to minimize the crimp of weaving yarn at a crossing point of warp and weft, it is desirable that the fiber constituting the weaving yarn has as large a yarn size as possible, the weaving yarn is thinner, and the warp and weft have yarn intervals that are nearly equal to their yarn width in making up the fabric.

On the other hand, however, the yarn width tends to considerably increase as the yarn size of weaving yarn increases, thus the flatness of yarn is crushed at the time of weaving, making it impossible to produce a fabric with a uniform fiber density. There is another problem in that, if weaving yarn is extremely thin and has an extremely small width, then the rigidity in the direction of the yarn width becomes low, causing the flatness of yarn to be easily crushed at the time of weaving.

In this case, it is desirable to apply a sizing agent to the weaving yarn to maintain the flatness of the weaving yarn. Excessive application of the agent, however, will prevent the resin infiltration for CFRP at the time of molding, and the resulting CFRP will fail to exhibit high strength. The desirable amount of the sizing agent to be applied is 0.5 to 2.0 percentage by weight.

Further, in the thin woven fabric and its weaving method disclosed in Unexamined Japanese Patent Publication No. 58-191244 previously mentioned, to form medium or thick CFRP, an enormous number of pieces of base fabric or woven fabric prepreg must be laid up. Thus, this method is disadvantageous in that the formed CFRP costs high and the forming work is extremely time-consuming.

Hence, conventionally, using a CF yarn with a larger yarn size prevents acquisition of a CFRP featuring excellent strength, and no satisfactory method or apparatus is available for weaving a CF fabric from a flat CF yarn. There has been demand for satisfactory method or apparatus for that purpose.

SUMMARY OF THE INVENTION

An object of the present invention is to provide an inexpensive CF fabric which is capable of exhibiting high strength as a reinforcing base fabric for composite materials.

Another object of the present invention is to provide a weaving method and a weaving apparatus which make it possible to weave the above-mentioned CF fabric while maintaining the flatness of yarn without causing twist even when a flat CF yarn with a larger yarn size is used.

To fullfill the above objects, present invention provide a carbon fiber woven fabric which comprises a flat carbon fiber yarn consisting of many carbon fibers as at least its warp or weft, said flat carbon fiber yarn being twist-free and the number of carbon fibers thereof being 6,000 to 36,000, the yarn size from 3,000 to 30,000 deniers, the yarn width from 4 to 16 mm, the yarn thickness from 0.07 to 0.6 mm, and the ratio of yarn width to yarn thickness from 20 to 150, and said carbon fiber woven fabric using said flat carbon fiber yarn which has a yarn width ranging from 4 to 16 mm, a yarn thickness ranging from 0.07 to 0.6 mm, a ratio of yarn width to yarn thickness ranging from 20 to 150, a ratio of the weaving yarn pitch between the warps and between the wefts to said yarn width ranging from 1.0 to 1.2, a fabric thickness ranging from 0.1 to 0.6 mm, a weight of woven fabric ranging from 90 to 500 g/m$^2$, and a fiber density of woven fabric ranging from 0.8 to 1.2 g/cm$^3$.

Preferably, in said CF fabric, said flat CF yarn has 6,000 to 24,000 carbon fibers, a yarn size of 3,000 to 20,000 deniers, and a thickness of 0.07 to 0.2 mm, and said CF fabric having a yarn thickness of 0.07 to 0.2 mm, a ratio of yarn width to yarn thickness of 30 to 150, a woven fabric thickness of 0.1 to 0.4 mm, and a weight of woven fabric ranging from 100 to 300 g/m$^2$.

Further preferably, the weight of woven fabric and the yarn size of the CF yarn of said CF fabric satisfy the relationship given in the formula shown below and also the cover factor is in a range of 95 to 100%.

$$W=k\cdot D^{\frac{1}{2}}$$

where

W: Weight of woven fabric k: Proportional constant (1.6 to 3.5)

D: Yarn size of warp or weft which are CF yarn

Preferably, in said CF fabric, said flat CF yarn has 6,000 to 24,000 carbon fibers, a yarn size of 3,000 to 20,000 deniers, and a thickness of 0.07 to 0.2 mm, and the CF fabric is a unidirectional woven fabric having a yarn thickness of 0.07 to 0.2 mm, a ratio of yarn width to yarn thickness of 30 to 150, a fabric thickness of 0.1 to 0.3 mm, and a weight of woven fabric of 90 to 200 g/m$^2$.

Further preferably, the weight of woven fabric and the yarn size of the CF yarn of said CF fabric satisfy the relationship given in the formula shown below and also the cover factor is in a range of 95 to 100%.

$$W=k\cdot D^{\frac{1}{2}}$$

where

W: Weight of woven fabric k: Proportional constant (0.9 to 2.0)

D: Yarn size of warp or weft which are CF yarn

Preferably, in said CF fabric, said flat CF yarn consists of a plurality of layers of flat, unit CF yarn, the number of the carbon fibers of the unit CF yarn ranging from 3,000 to 12,000, a yarn size ranging from 1,500 to 10,000 deniers, a yarn width ranging from 4 to 16 mm, a yarn thickness ranging from 0.07 to 0.2 mm, and a ratio of yarn width to yarn thickness ranging from 30 to 150, and said CF fabric having a yarn width ranging from 4 to 16 mm, a yarn thickness ranging from 0.07 to 0.6 mm, a ratio of the yarn width to the yarn thickness ranging from 20 to 100, a ratio of the weaving yarn pitch to the yarn width ranging from 1.0 to 1.2, the fabric thickness ranging from 0.2 to 0.6 mm, a weight of woven fabric ranging from 200 to 500 g/m$^2$, and a fiber density of woven fabric ranging from 0.8 to 1.2 g/cm$^3$.

Further preferably, the weight of woven fabric and the yarn size of the CF yarn consisting of a plurality of layers of unit CF yarns of the CF fabric satisfy the relationship given in the formula shown below and also the cover factor is in a range of 95 to 100%.

$$W=k\cdot D^{\frac{1}{2}}$$

where

W: Weight of woven fabric k: Proportional constant (2.0 to 4.2)

D: Yarn size of CF yarn consisting of a plurality of layers of unit CF yarn

Preferably, each of the aforesaid CF fabric is infiltrated with a matrix resin of 30 to 67 percentage by weight to turn it into a prepreg.

Further preferably, each of the aforesaid CF fabric is infiltrated with a matrix resin of 30 to 67 percentage by weight to turn it into a fiber reinforced plastic.

Also preferably, the matrix resin is a thermosetting resin, the tensile break elongation thereof is 3.5 to 10%, or a thermoplastic resin, the tensile break elongation thereof is 8 to 200%.

Said CF fabric consists of crossing warp and weft made of flat CF yarn and its woven fabric structure is not particularly restricted. However, even in the case of a structure which is seen in a plain weave fabric wherein individual weaving yarns alternately cross each other and easily produce large crimps, the weaving yarns themselves are flat and thin; therefore, in the actual fabric, the crimps of the weaving yarns are controlled to a minimum and the strength is not affected.

For the flat CF yarn, a fiber bundle comprising a plurality of fibers may be combed into a ribbon-like shape before reaching a sizing process in a fiber manufacturing process and a sizing agent is applied to them to maintain the shape then the ribbon-like fiber bundle may be wound around a bobbin. Alternatively, the CF yarn may be opened and formed into a ribbon-like shape in a different process before it is glued together with a sizing agent.

The CF yarn especially features high strength and high tensile modulus, however, it cannot fully exhibit the high strength, which is a feature of CF, if the weaving yarn is crimped as described above. Hence, to obtain a CF fabric with a small crimp ratio and a uniform fiber density, it is necessary to use a thin, flat CF yarn free of twists and weave the yarn into a fabric at a pitch which is nearly equal to the width of the yarn.

Hence, the flat CF yarn preferably is free from twists and the number of CF thereof is 6,000 to 24,000 and the yarn size is 3,000 to 20,000 deniers. To acquire an appropriate fabric thickness, the yarn width should be 4 to 16 mm, the yarn thickness 0.07 to 0.2 mm, and the ratio of the yarn width to the yarn thickness 30 to 150.

The flat CF yarn may also consist of a plurality of layers of a flat unit CF yarn free from twists, the number of carbon fibers thereof ranging from 3,000 to 12,000, the yarn size ranging from 1,500 to 10,000 deniers, the yarn width ranging from 4 to 16 mm, the yarn thickness ranging from 0.07 to 0.2 mm, and the ratio of the yarn width to the yarn thickness ranging from 30 to 150.

To maintain the flatness of the CF yarn, it is desirable to apply a small amount of a sizing agent of about 0.5 to 2.0 percentage by weight to the CF yarn.

It is a must for the CF yarn to have no twist. If the CF yarn should have any twist, then the yarn will be squeezed and the yarn width will be decreased at the twisted portion, resulting in an increased thickness, thus causing irregularities on the surface of the woven fabric. As a result, when an external force is applied to the woven fabric, the stress will be concentrated onto the twisted portion, leading to nonuniform strength when the fabric is formed into FRP or the like.

To weave with such a flat CF yarn free from twists, the CF fabric weaving method according to the present invention, whereby a CF fabric is woven by using twist-free, flat CF yarn as at least its warp or weft, said flat Cf yarn consists of a plurality of carbon fibers and by supplying weft to between a plurality of arranged warps, is designed to comprise at least a weft supply process, wherein the flat weft is subjected to the transverse take-out and positioned horizontally in the weft supply position by a guiding means, the weft of a length required for each insertion of weft for the aforesaid warp is retained between the take-out position of the weft and the guiding means by making use of the elastic force, and the weft with the tension applied is supplied to the guiding means, and a warp supply process, wherein the plurality of flat warps are subjected to the transverse take-out, the plurality of warps are held so that their flat surfaces lie in a direction crossing at right angle the arranged direction and combed to the desired density in relation to the arranged direction, then the direction of the flat surfaces of the individual warps is changed to the arranged direction to lead them to a shuttle path forming means.

According to the CF fabric weaving apparatus of the present invention, whereby a CF fabric is woven by using twist-free, flat CF yarn, at least the flat warp or weft thereof consists of a plurality of carbon fibers, and by supplying weft to between a plurality of arranged warps, the apparatus for weaving CF fabric is designed to comprise at least either a weft supply means, which includes a draw-off roller that rotates interlocking with a rotary main shaft of the weaving apparatus and pays out the flat weft from a weft bobbin wound with weft at a constant speed, at least two guide rollers which horizontally place the paid out weft in the weft supply position, a weft elastic suspension mechanism which elastically retains the weft of a length required for each insertion of weft into warps at between the draw-off roller and the guide rollers and supplies the weft to the foregoing at least two guide rollers, and a tension applying mechanism which keeps under tension the weft received from the guide rollers, or a warp supply means, which includes a comb that has a plurality of wires and combs the individual warps paid out from a plurality of warp bobbins wound with flat warps by bringing the individual warps into contact only with the wires located in the corresponding positions, thereby arranging them to the desired density while maintaining the flatness of the warps, a guide which change the orientation of the plurality of warps received from the comb into a direction that crosses with the plurality of wires of the comb at right angle, and a heald which opens and closes the plurality of warps received from the guide while maintaining their new orientation.

In the past, even when a flat, high-performance CF yarn having high tensile strength and high tensile modulus is used, the flatness of the CF yarn was partially or completely crushed during the fabric weaving process, resulting in an elliptic cross section of the CF yarn. Accordingly, the weaving yarn constituting the CF fabric also becomes elliptic with large crimps, and when a CFRP is produced by infiltrating the CF fabric with a matrix resin, stress concentration took place at bent portions of the weaving yarn, preventing the tensile strength or the tensile modulus of the CF yarn used from being fully exhibited. To be more specific, the crimped weaving yarn led to deteriorated tensile strength or tensile modulus.

The CF fabric according to the present invention which is woven using the above-mentioned weaving method and the weaving apparatus according to the present invention has small crimps of weaving yarn and a small area of gaps in the whole fabric area. For this reason, when the CF fabric according to the present invention is infiltrated with resin to turn it into a composite material, the resin which is charged unevenly in the gaps in the fabric will be decreased. As a result, when the composite material is subjected to a stress, the resin in the gaps does not develop cracks, allowing the woven fabric structure to exhibit high strength.

In this case, the flat CF yarn used is the one which has a tensile break elongation of 1.5 to 2.3%, a tensile break strength of 200 to 800 kg·f/mm$^2$, and a tensile modulus of 20,000 to 70,000 kg·f/mm$^2$ according to ASTM D3039 (Tensile Properties of Fiber-Resin Composites).

The CF fabric according to the present invention especially features small crimps. In a CFRP which uses a conventional CF fabric, usually, the matrix resin breaks prior to the break of the CF yarn in an area developing small tensile distortion caused by crimps of the weaving yarn. In the CFRP using the CF fabric with small crimps according to the present invention, the break of the matrix resin caused by the crimps of the weaving yarn described above does not take place.

Thus, the CFRP using the CF fabric according to the present invention does not suffer from deteriorated strength due to the break of the matrix resin and therefore it provides high tensile break strength and tensile modulus even when a CF yarn having a high tensile break elongation or tensile break strength is used.

The CF fabric woven using the warp and weft consisting of said flat CF yarn has a fabric structure which maintains spaces between yarn that are nearly equal to the yarn width. This means that there are almost no gaps at the crossing portions of the warp and weft, resulting in a fabric featuring a high fiber density.

In the woven CF fabric, however, warp and weft actually cross, and it is difficult to make the space between weaving yarns equal to the yarn width. To deal with this problem, in the woven CF fabric, the space between either the warps or wefts is to be made equal to the yarn width, while the space between warp and weft may be slightly larger than the yarn width. If, however, the space between weaving yarns exceeds 1.2 times the yarn width, then the gaps will be larger and no fabric with a high fiber density can be produced.

For this reason, it is desirable that the weaving yarn pitch of the warp and weft be 1.0 to 1.2 times the yarn width, i.e., the ratio of the weaving yarn pitch to the yarn width be 1.0 to 1.2.

The fiber density of woven fabric refers to the value defined by the following formula:

Fiber density of woven fabric (g/cm$^3$) =

[Weight of woven fabric (g/m$^2$)]/[Thickness of woven fabric (mm)]

The values of the weight of woven fabric (g/m$^2$) and the thickness of fabric (mm) are measured in accordance with ASTM D3776 (Standard Test Methods Mass Per Unit Area of Woven Fabric) and D1777 (Standard Method For Measuring Thickness of Textile Materials).

When the CF fabric according to the present invention is woven using warp and weft which consists of a flat, non-laminated CF yarn and which has a yarn width of 4 to 16 mm and a yarn thickness of 0.07 to 0.2 mm, the resulting CF fabric will have a ratio of the yarn width to the yarn thickness of 30 to 150, a ratio of the weaving yarn pitch to the yarn width of 1.0 to 1.2, a fabric thickness of 0.1 to 0.4 mm, a weight of woven fabric of 100 to 300 g/m$^2$, and a fiber density of 0.8 to 1.2 g/cm$^3$.

Further, when the unidirectional CF fabric according to the present invention is woven using warp or weft which consists of a flat CF yarn measuring a yarn width of 4 to 16 mm and a yarn thickness of 0.07 to 0.2 mm and an auxiliary yarn, the resulting CF fabric will have a ratio of the yarn width to the yarn thickness of 30 to 150, a ratio of the weaving yarn pitch to the yarn width of 1.0 to 1.2, a fabric thickness of 0.1 to 0.3 mm, a weight of woven fabric of 90 to 200 g/m$^2$ and a fiber density of 0.8 to 12 g/cm$^3$.

Furthermore, when the CF fabric according to the present invention is woven using warp and weft which consists of a plurality of layers of a flat, unit CF yarn measuring a yarn width of 4 to 16 mm and a yarn thickness of 0.07 to 0.2 mm, the resulting CF fabric will have a ratio of the yarn width to the yarn thickness of 20 to 100, a ratio of the weaving yarn pitch to the yarn width of 1.0 to 1.2, a fabric thickness of 0.2 to 0.6 mm, a weight of woven fabric of 200 to 500 g/m$^2$, and a fiber density of 0.8 to 1.2 g/cm$^3$.

In this case, if a CF fabric is woven using a CF yarn or unit CF yarn, the number of fibers thereof is 6,000 to 36,000 and the yarn size is 3,000 to 30,000 deniers, and if the weight of woven fabric is smaller than 90 g/m$^2$, then it means that the CF fabric is woven using an extremely flat CF yarn, making the weaving difficult. Even if the fabric is woven, the flatness of the CF yarn would be crushed, and a fabric with an extremely coarse texture will result. On the other hand, if the weight of woven fabric is larger than 500 g/m$^2$, then the infiltration of a matrix resin for forming a prepreg or CFRP will be adversely affected and many voids will be generated in the resin.

The same applies if the CF fabric according to the present invention is woven using a flat CF yarn and auxiliary yarn.

Likewise, if the thickness of a CF fabric is smaller than 0.1 mm, then more layers will be required with consequent complicated laminating work for producing a CFRP, and also more spaces between layers will result, contributing to the disadvantage of the CFRP. On the other hand, if the thickness of the CF fabric is larger than 0.6 mm, then the infiltration of a matrix resin will be adversely affected in the process of forming a prepreg or CFRP and many voids will be generated in the resin just as in the case where the weight of woven fabric is too large. The same problems as those related to the thickness of the CF fabric described above occur if a flat CF yarn and auxiliary yarn are used to weave the CF fabric according to the present invention.

The CF fabric according to the present invention is characterized by that the conditions described above are satisfied and the fiber density defined by the aforesaid formula is 0.8 to 1.2 g/cm$^3$.

In general, the strength of a CFRP depends on the volume content of CF and therefore, a base fabric with high fiber density is necessary to obtain high strength.

The volume content of the fiber in FRP refers to the ratio of the volume of a base fabric to the volume of the FRP.

In this case, a CF fabric with a high fiber density can be acquired by increasing the weaving density of the CF yarn used.

In the past, however, increasing the weaving density caused larger crimps of the CF yarn in a CF fabric and no CFRP with high strength could be produced.

For this reason, in the conventional CF fabrics, it was necessary to set the fiber density of fabrics to a value smaller than 0.8 g/cm$^3$. Especially when a CF yarn of a large yarn size is used, the fiber density of the fabric had to be set to an even smaller value.

The CF fabric according to the present invention uses a flat CF yarn with a large yarn size, a yarn width of 4 to 16 mm, and a ratio of the yarn width to the yarn thickness of 20 to 150, and it is woven with a yarn interval which is nearly equal to the yarn width, 1.0 to 1.2 times (the weaving yarn pitch / yarn width ratio = 1.0 to 1.2).

Thus, the CF fabric obtained has a minimum of voids or crimps of weaving yarn and a high fiber density of the fabric, and it is capable of exhibiting high strength even if the fiber density exceeds 0.8 g/cm$^3$.

Further, the CF fabric according to the present invention should satisfy the conditions described above, and its weight of woven fabric and the yarn size of the CF yarn satisfy the relationship of $W = k \cdot D^{\frac{1}{2}}$, the cover factor being 95 to 100%.

If the cover factor is smaller than 95%, then more voids are likely to be generated between the CF yarns, causing a matrix resin to be unevenly present in the voids when producing a prepreg or CFRP, thus adversely affecting the strength.

In this case, "W" refers to the weight of woven fabric (g/m$^2$), "k" a proportional constant (1.6 to 3.5), and "D" the size of yarn (denier) of a CF yarn consisting of many carbon fibers.

Additionally, in the case of a unidirectional fabric which uses warp or weft made of CF yarn and an auxiliary yarn, it is desirable that the proportional constant "k" be 0.9 to 2.0, or 2.0 to 4.2 for a fabric which uses a CF yarn made of a plurality of layers of unit CF yarn.

To weave a CF fabric with a relatively small weight of woven fabric and a CF yarn with a large size of yarn at a cover factor of 95 to 100% means to weave using a CF yarn with an extremely large yarn width. Hence, the resultant CF fabric will not be a high-quality fabric with its CF yarn uniformly distributed primarily because the width of the CF yarn is squeezed widthwise when weaving.

On the other hand, if a CF fabric with a relatively large weight of woven fabric is woven with a CF yarn with a small size of yarn, then a fabric with large crimps on the weaving yarn will result.

Here, the cover factor $C_f$ refers to a factor related to the size of a gap formed between weaving yarns, and its value is defined by the following formula when an area of $S_1$ is set on the fabric and the area of the gap formed between the weaving yarns in the area $S_1$ is taken as $S_2$:

$$C_f = \{(S_1 - S_2)/S_1\} \times 100\ (\%)$$

In the CF fabric, the larger the value of the cover factor $C_f$, the smaller the area of the gap becomes. This prevents, at the time of the infiltration of a matrix resin, the matrix resin from being unevenly filled in the gap. As it is obvious from the above formula, however, the value of the cover factor $C_f$ never exceeds 100%.

When the CF fabric according to the present invention is woven with warp or weft made of a flat CF yarn and an auxiliary yarn, the auxiliary yarn is preferably a flat weaving yarn consisting of thin fiber having a yarn size of 2,000 deniers or less, and more preferably, 50 to 600 deniers.

An auxiliary yarn of a larger yarn size tends to cause larger crimps, while one with a smaller yarn size permits easier cutting when weaving or handling.

The auxiliary yarn is used to hold parallel flat weaving yarns together. There is no particular restrictions on the type of yarn used as the auxiliary yarn. It may be an inorganic fiber such as a CF and glass fiber or an organic fiber such as aramid fiber, vinylon fiber, and polyester fiber.

The prepreg using the aforesaid CF fabric can be produced by infiltrating the fabric with a matrix resin according to a known method.

Matrix resin used for that purpose includes thermosetting resins such as epoxy resin, unsaturated polyester resin, and phenolic resin. Such matrix resins are in the B-stage when they are infiltrated in a CF fabric.

Alternatively, the matrix resin used may be a thermoplastic resin such as polyamide resin, polyester resin, polybutylene terephthalate resin, polyimide resin, poly ether ether ketone resin, and bis-maleimide resin.

The amount of the matrix resin contained in the CF fabric is preferably 30 to 67 percentage by weight, and more preferably, 34 to 45 percentage by weight.

The CFRP using the aforesaid prepreg can be molded by laying up a specified number of pieces of the prepreg into layers in a specified orientation according to a known method. More specifically, if a thermosetting resin is used as the matrix resin, the resin is cured under a pressure of 4 to 10 kg/cm$^2$ while the laminated prepreg is heated to a temperature of 100° to 200° C. If a thermoplastic resin is used as the matrix resin, the resin is melted by heating it above its melting point while applying a pressure of 7 to 30 kg/cm$^2$ to the laminated prepreg, then it is cooled.

A CF fabric using warp and weft consisting of a flat CF yarn made of many carbon fibers has small crimps. Hence, the CFRP using this fabric does not develop breakdown of a matrix resin prior to break of the CF yarn in the small tensile strain area caused by crimps of the weaving yarn; therefore, the break elongation in the direction tensile stress works increases, which means increased strength.

Hence, the CFRP is, for example, stronger in the direction of warp when it is pulled in the direction of the warp used for the fabric. The CFRP, however, develops microcracks along the CF when it is pulled in the direction crossing the tensile stress at right angle, i.e., the direction of the weft, because the weft is pulled in a direction at right angle with respect to the orientation of the fibers and also because the weft is broader than an ordinary weaving yarn.

The inventors studied the occurrence of the microcracks from the aspect of the matrix resin, and found that increasing the tensile break elongation effectively controls the occurrence of microcracks.

Accordingly, the desirable tensile break elongation of the matrix resin is 3.5 to 10% for a thermosetting resin or 8 to 200% for a thermoplastic resin when it is measured according to ASTM D638 (Standard Test Method for Tensile Properties of Plastics).

The CF fabric according to the present invention, which is woven with warp and weft consisting of a flat, twist-free CF yarn that has a yarn width of 4 to 16 mm and a ratio of yarn width to yarn thickness of 20 to 150 and which has a ratio of weaving yarn pitch to yarn width of 1.0 to 1.2, a fabric thickness of 0.1 to 0.6 mm, a weight of woven fabric of 90 to 500 g/m$^2$, and a fiber density of 0.8 to 1.2 g/cm$^3$, permits weaving with the flatness of both warp and weft unimpaired, thus controlling the crimps at points where the warp and weft cross each other to a minimum with a resultant uniform fiber density in the fabric.

Furthermore, the CF fabric according to the present invention is woven using warp and weft consisting of flat CF yarn with an extremely coarse yarn density and it has small crimps on the weaving yarn, so that the fabric is easily subjected to shear deformation. In other words, if the CF fabric according to the present invention is subjected to shear deformation, it permits significant deformation without generating wrinkles because the fabric has adequate allowance to decrease the spaces between the warp or weft, so that the spaces between the yarns can be reduced while decreasing the yarn width of the flat CF yarn. This makes it possible to adapt the CF fabric to a molding tool which has a complicated shape.

Moreover, the CF fabric according to the present invention features a uniform fiber density and small gaps between the warp and weft so that it can be fitted to a molding tool by subjecting only the portion, which contacts the curved surface of the molding tool, to shear deformation. Therefore, the CF fabric according to the present invention allows a surface even with a large curvature of the molding tool to be provided with uniformly high fiber covering.

The prepreg or CFRP using the aforesaid CF fabric as its reinforcing base fabric exhibits high strength since it incurs almost no void in the resin owing to its good resin infiltration property.

In the weaving method and weaving apparatus for CF fabric according to the present invention, twisting the weft at the time of weaving can be prevented by transversely taking out the weft while giving a weft bobbin a given rotation by a draw-off roller interlocked with a main rotary shaft of the apparatus, causing the slack in the weft, which is generated by an insertion of the weft into warps, to be absorbed, positioning the weft by guide rollers, and applying tension to the weft by a tension applying mechanism.

Further in the weaving method and weaving apparatus for CF fabric according to the present invention, a CF fabric can be woven with the flatness of the warps unimpaired by transversely taking out the warps from a plurality of warp bobbins, combing the warps by bringing the flat surfaces of the warps into contact only with the wires of the comb to arrange them to the desired density, and changing the orientation of the flat surfaces of the warps into the horizontal direction before guiding them to a heald.

According to the weaving method and weaving apparatus for CF fabric of the present invention, a CF fabric can be woven without causing flat CF yarns to be twisted or the flatness to be crushed, thus allowing extremely thin fabrics to be produced with consistent quality. Hence, using this fabric for producing prepregs or CFRPs prevents such problems as irregularities on the surface caused by irregular thickness occurring in yarn-twisted portions, excess resin in gaps in yarn-twisted portions, occurrence of voids, and deteriorated strength due to concentration of stress onto twisted portions.

Furthermore, the CF fabric according to the present invention uses a flat CF yarn of a large yarn size and consists of flat weaving yarns, the ratio of yarn width to yarn thickness thereof is 20 to 150, the weaving yarns being arranged in parallel at intervals nearly equal to the yarn width. The weight of woven fabric is 90 to 500 g/m$^2$, the thickness of fabric is 0.1 to 0.6 mm, and the fiber density of the fabric is 0.8 to 1.2 g/cm$^3$, and there is almost no gaps between weaving yarns. The result is a high-density woven fabric with extremely uniform fibers.

Conventionally, a thin CF fabric, in particular, was an extremely expensive fabric because it was woven with expensive CF yarns with a small yarn size at a high density. According to the weaving method of the present invention, an inexpensive CF yarn with a large yarn size is used and the fabric is woven at a low density, thus achieving higher productivity and lower weaving cost.

Moreover, since the CF fabric according to the present invention is woven coarsely with a flat CF yarn, it permits easy shear deformation, making it possible to fit itself uniformly along a molding tool which has a complicated configuration. In addition, since the CF fabric woven with a flat CF yarn at a low density, the crimps of the weaving yarn are small, and furthermore, the flat CF yarn is of a large yarn size, and the fiber density of the fabric is high, 0.8 to 1.2 g/cm$^3$. For this reason, the gaps between the warps and wefts of the CF fabric are small; therefore, the volume content of the carbon fiber of a resultant CFRP will be high, exhibiting excellent advantages such as extremely high strength.

In addition, the CF fabric according to the present invention has a smooth surface; therefore, when it is used to produce a CFRP, the surface of the CFRP will be smooth, permitting easy painting.

The above and other objects, characteristics and advantages of the present invention will become more apparent from the following detailed description made in connection with the accompanying drawings.

DETAILED DESCRIPTION OF THE PREFERRED EMBODIMENTS

The following presents detailed description of an embodiment related to the CF fabric, its weaving method and weaving apparatus according to the present invention, referring to FIG. 1 through FIG. 9.

Figure 1:
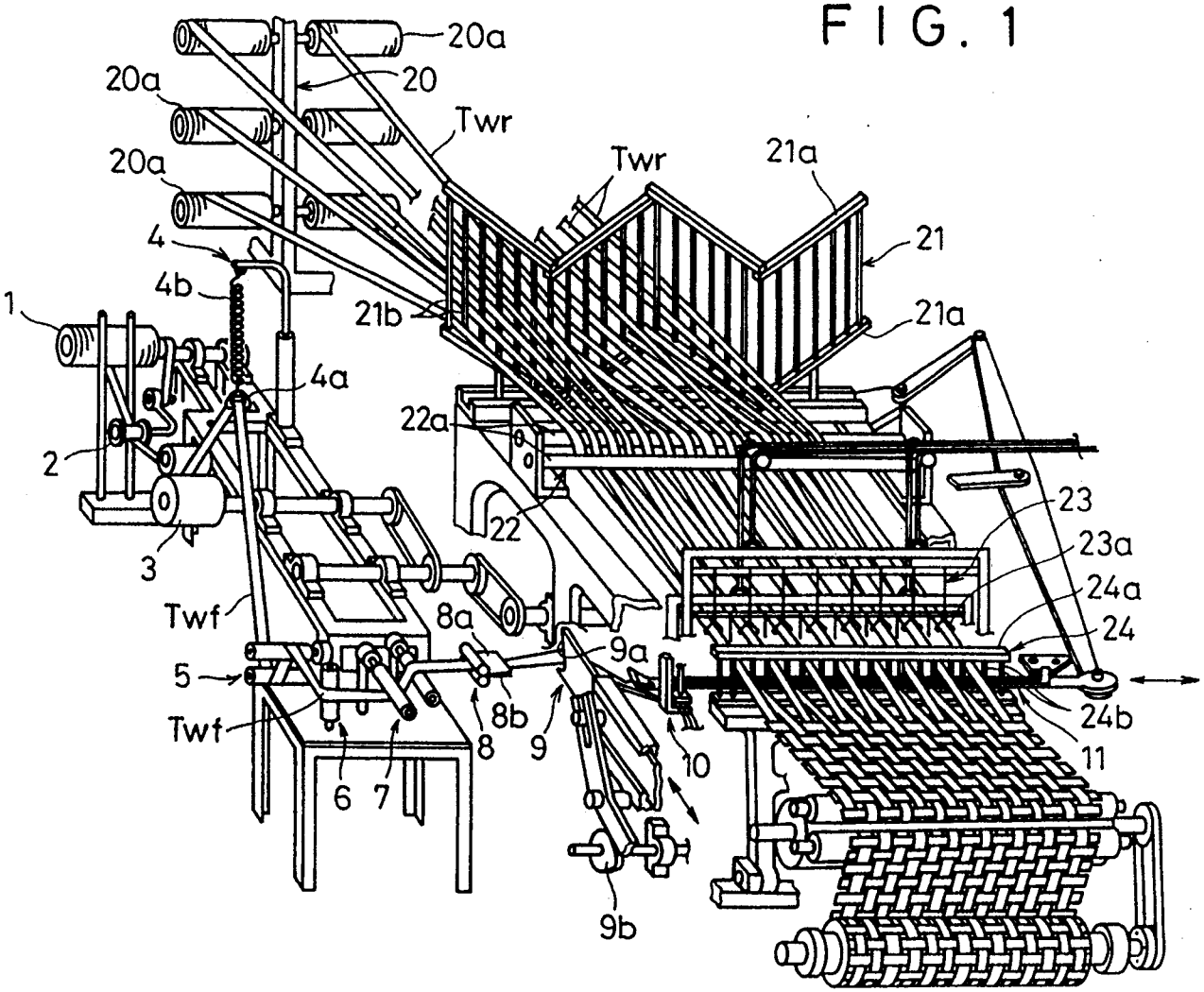
FIG. 1 is a schematic configuration diagram of the weaving apparatus for weaving CF fabric by applying the weaving method for CF fabric according to the present invention.

FIG. 1 shows a weaving apparatus which weaves a CF fabric by applying the weaving method for CF fabric according to the present invention. The weaving apparatus is provided with a bobbin 1, a draw-off roller 3, a tension device 4, guide rollers 5 to 7, a leaf spring tension device 8, a presser plate guide 9, and a rapier 11 mainly as a weft supply unit, and it is provided with a creel 20, comb 21, a horizontal guide 22, a heald 23, and a reed 24 as a warp supply unit.

First, the weft supply unit will be explained. The bobbin 1 is wound with a weft $T_{wf}$, which is a flat CF yarn consisting of many carbon fibers, and the weft $T_{wf}$ is guided to the draw-off roller 3 via the tension roller 2 then it is taken out at a constant speed by the revolution of the draw-off roller 3.

In this case, when the weft $T_{wf}$ is taken out from the bobbin 1, the tension roller 2 is in its upper position, while the roller automatically moves down when the revolution of the draw-off roller 3 stops, and a brake is operated to stop the inertial rotation of the bobbin 1. The draw-off roller 3 rotates, being interlocked to a main rotary shaft 26 of the weaving apparatus to be described later, and the main rotary shaft 26 is rotated by a driving motor 25 (see FIG. 3) to be discussed later.

The speed at which the weft $T_{wf}$ is taken out, i.e., the surface speed obtained by the rotation of the draw-off roller 3, can be easily determined when the number of revolutions (rpm) of the main rotary shaft 26 and the length (m) of the weft required for one rotation are found.

The CF yarn for the weft $T_{wf}$ and warp $T_{wr}$ is twist-free and has 6,000 to 36,000 carbon fibers. The CF yarn is maintained in a flat shape using a sizing agent or the like in advance and it is wound around a bobbin 1, which is a cylindrical tube having a given traverse width, or bobbins 20*a* and 20*b* of the creel 20 to be described later.

The CF yarn to be used has a yarn size of 3,000 to 30,000 deniers, a yarn width of 4 to 16 mm, a yarn thickness of 0.07 to 0.6 mm, and a ratio of yarn width to yarn thickness of 20 to 150. If a flat unit CF yarn formed into a plurality of layers is used, the unit CF yarn must be free of twists and have 3,000 to 12,000 carbon fibers, a yarn size of 1,500 to 10,000 deniers, a yarn width of 4 to 16 mm, a yarn thickness of 0.07 to 0.2 mm, and a ratio of yarn width to yarn thickness of 30 to 150.

The weft $T_{wf}$ taken out from the draw-off roller 3 is led to the leaf spring tension device 8, being guided by the horizontal guide roller 5, a vertical guide roller 6, and a horizontal guide roller 7 via a guide 4a of the tension device 4.

Each of the guide rollers 5 through 7 preferably has a diameter of approximately 10 to 20 mm and a length of 100 to 300 mm, and is preferably of a rotary type which incorporates a bearing. If the diameter is too small, then the CF constituting the weft $T_{wf}$ bends, often causing a single yarn to break. On the other hand, if the diameter exceeds 20 mm, a problem occurs in which the inertia of rotation increases, causing increased changes in tension at the time of start and stop.

The guide rollers 5 through 7 need to have a sufficient length so that the passing weft $T_{wf}$ does not come in contact with the support portion which support the guide rollers 5 through 7 when the weft $T_{wf}$ moves horizontally or vertically. If the weft $T_{wf}$ should touch the support portion of the guide rollers 5 through 7, then the flatness is crushed.

The horizontal guide roller 5 and 7 determines the height of the weft $T_{wf}$ to be guided, while the vertical guide roller 6 determines the horizontal position of the weft $T_{wf}$. Accordingly, at least horizontal and vertical guide rollers 5 through 7 need to be installed alternately.

In this case, it is necessary to twist the flat surfaces of the weft $T_{wf}$ 90 degrees at between the horizontal guide rollers 5 and the vertical guide roller 6 and at between the vertical guide roller 6 and the horizontal guide rollers 7. For this reason, a distance of 50 mm or more must be provided between the guide rollers 5 and 6 and between the guide rollers 6 and 7 although it varies depending on the width of the weft $T_{wf}$.

If the distance between the guide rollers is smaller than 50 mm, then the weft $T_{wf}$ will pass through the vertical guide roller 6 and the horizontal guide rollers 7 and will be woven in a twisted state. Likewise, if the CF yarn is twisted 90 degrees in a shorter distance, then tension will be applied to both ends of the CF yarn, causing fuzz to be generated.

It is possible to use only a single guide roller for each of the rollers 5 through 7, but using a pair of them so that the weft $T_{wf}$ passes in an S shape ensures consistent tension applied to the weft $T_{wf}$ and therefore permits accurate positioning of the weft $T_{wf}$.

The tension device 4 functions to constantly keep the weft $T_{wf}$ tense by absorbing the slack between the draw-off roller 3 and the horizontal guide rollers 5 of the weft $T_{wf}$ which is taken out at a constant speed by the draw-off roller 3 when the weft $T_{wf}$ is inserted intermittently by the rapier 11 to be discussed later. Unless the weft $T_{wf}$ is kept tense by a spring 4*b*, it is twisted when it slacks and it is likely to pass through the guide rollers 5 through 7 and be woven in the twisted state. A guide 4*a* provided at the bottom end of the spring 4*b* is arranged sideways so that the flat surfaces of the CF yarn is guided horizontally.

As another method for keeping the weft $T_{wf}$ tense, there is a method based on air suction, but this method presents a problem in that the weft $T_{wf}$ is twisted during suction. Likewise, in a method where a weight is used to keep the weft $T_{wf}$ tense, the fluctuations in tense tend to be too much, damaging the carbon fibers which make up the weft $T_{wf}$. Thus, the method which uses a spring as described above is the easiest and reliable method.

On the downstream side of the horizontal guide roller 7 of the weft $T_{wf}$ is provided a tension device 8 which functions to keep the tension of the weft $T_{wf}$ even. The tension device 8 keeps the tension of the weft $T_{wf}$ even by holding the weft $T_{wf}$ with two wide leaf springs 8*a* and 8*b*.

In the method for supplying the weft $T_{wf}$ of the CF fabric weaving apparatus according to the present invention, in principle, the yarn path of the weft $T_{wf}$ is determined by the vertical guide roller 6, but the yarn path of the weft $T_{wf}$ sometimes changes due to fluctuations in the tension or when hooking onto the rapier. For this reason, it is necessary to make sure that there is no obstacle that interferes with the side edge of the weft $T_{wf}$ when the weft $T_{wf}$ moves widthwise, and therefore, the tension device 8 provided with the wide leaf springs 8*a* and 8*b* is used. The width of the leaf springs 8*a* and 8*b* should be five times the yarn width of the weft $T_{wf}$ or more.

The presser plate guide 9 is located on the downstream side of the weft $T_{wf}$ of the leaf spring tension device 8, and it has a V-shaped guide surface 9*a* at its end. The guide 9 is interlocked with the yarn supplied to the rapier 11 and driven longitudinally as shown by the arrowhead in FIG. 1 by making use of the cam 9*b* to which the rotation of the main rotary shaft 26 is transferred.

Figure 5:
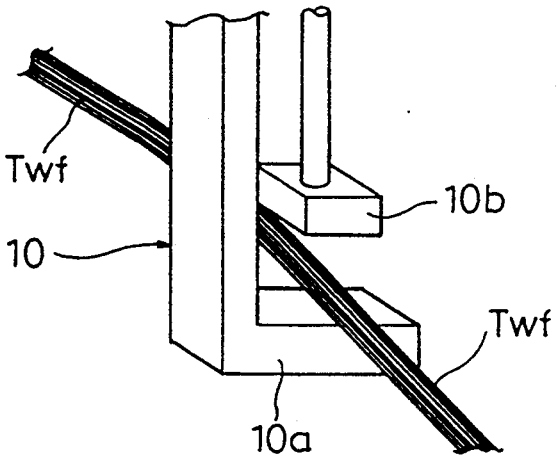
FIG. 5 is a perspective view which shows an enlarged view of a yarn end holding guide.

A yarn end holding guide 10 is located in the vicinity of the downstream side of the presser plate guide 9. The yarn end holding guide 10 has, as shown in FIG. 5, an L-shaped receiving member 10*a* and a pressing member 10*b* which is driven up and down by a driving means not shown. The pressing member 10*b* of the guide 10 goes down and holds the end of the weft $T_{wf}$ by pressing it against the receiving member 10*a*.

Thus, when the presser plate guide 9 is pushed out in the direction of the arrowhead and the flat surface of the weft $T_{wf}$ moves down as it is guided along the slope of the V-shaped guide surface 9*a*, the yarn end holding guide 10 also moves down. As the result of the weft $T_{wf}$ crossing the end of the rapier 11 with its flatness kept intact, it is properly hooked onto a hook 11*a* of the rapier 11 to be described later.

In this case, normally, the weft $T_{wf}$ is retained in a standby position by the yarn end holding guide 10 and a yarn supply guide having a guide hole so that the weft $T_{wf}$ crosses the rapier 11 aslant, and when the rapier 11 reaches the yarn supply position, both guides are moved down to cause the weft $T_{wf}$ to be hooked onto the hook 11*a* of the rapier 11. However, if a standard yarn supply guide is used for a weft $T_{wf}$ consisting of a flat CF yarn to supply the yarn to the rapier 11, then the weft $T_{wf}$ is rubbed by the above-mentioned guide hole, damaging the flatness.

To avoid this problem, in the weaving apparatus according to the present invention, the presser plate guide 9 is provided between the leaf spring tension device 8 and the yarn end holding guide 10. Thus, the yarn end holding guide 10 moves down and the presser plate guide 9 advances when the yarn is supplied to the rapier 11, thereby pressing the weft $T_{wf}$ against the rear of the weaving apparatus (farther side in FIG. 1) and making the weft $T_{wf}$ pass across the rapier 11.

Figure 2:
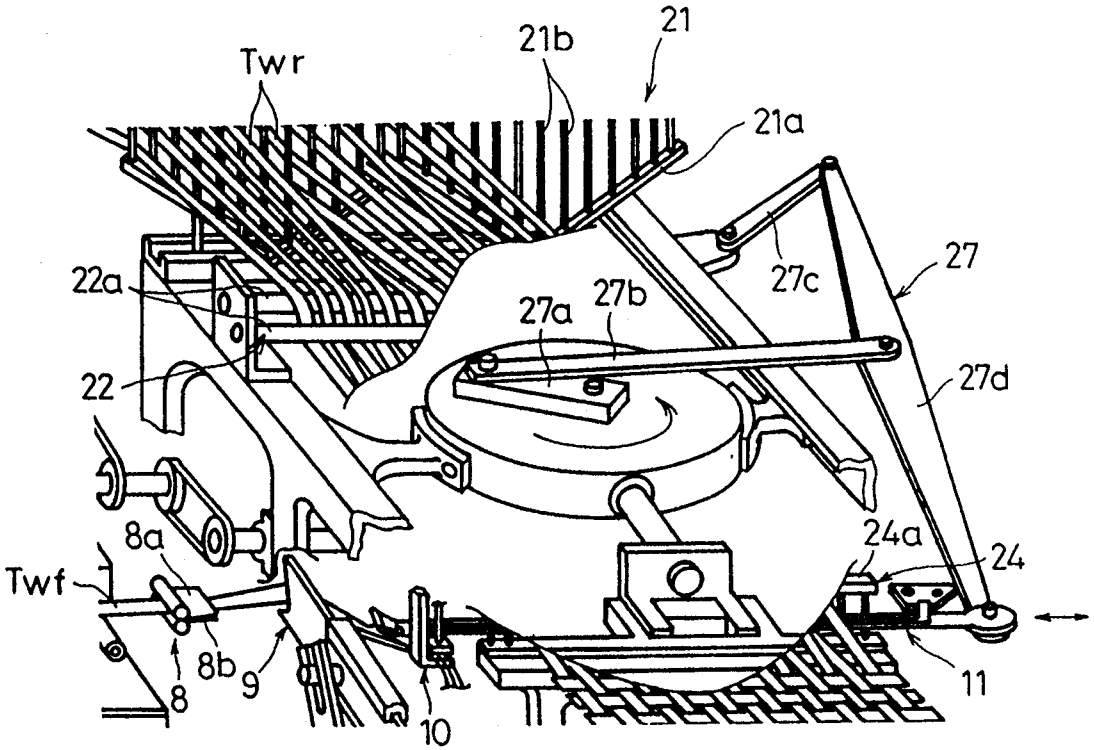
FIG. 2 is an enlarged view of the major section which shows a driving means of a rapier in the weaving apparatus of FIG. 1.
Figure 3:
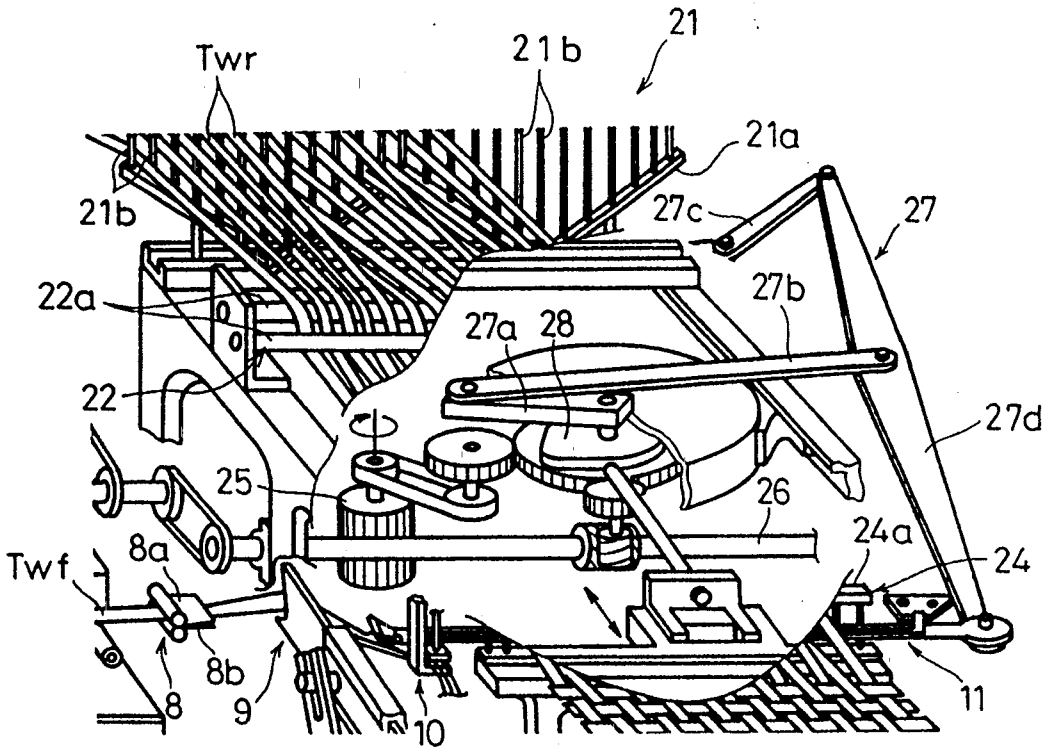
FIG. 3 is an enlarged view of the major section which shows more details of a part cut away from FIG. 2.
Figure 4:
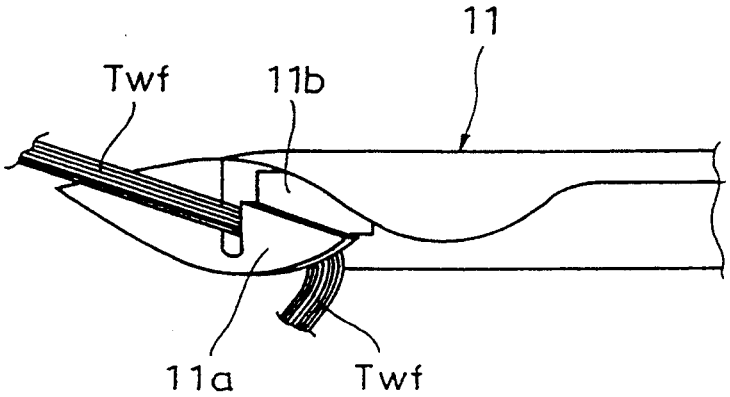
FIG. 4 is an enlarged view of the tip of the rapier.

As shown in FIG. 1, the rapier 11 is a longitudinal member located near a reed 24 to be discussed later, and it intermittently moves laterally to insert the weft $T_{wf}$ between multiple warps $T_{wr}$. The rapier 11, as shown in FIG. 2 and FIG. 3, is intermittently moved by the driving force transmitted from a driving motor 25 via a linking means 27 which has arms 27*a* through 27*d*. As shown in FIG. 4, the rapier 11 has, on its tip, the hook 11*a* for hooking the flat weft $T_{wf}$, and a presser member 11b being mounted near the hook 11*a*.

Accordingly, the weft $T_{wf}$ is hooked onto the hook 11*a* on the rapier 11 when the rapier 11 moves to the right in FIG. 1, then it is pressed and held by the presser member 11*b*.

Figure 6:
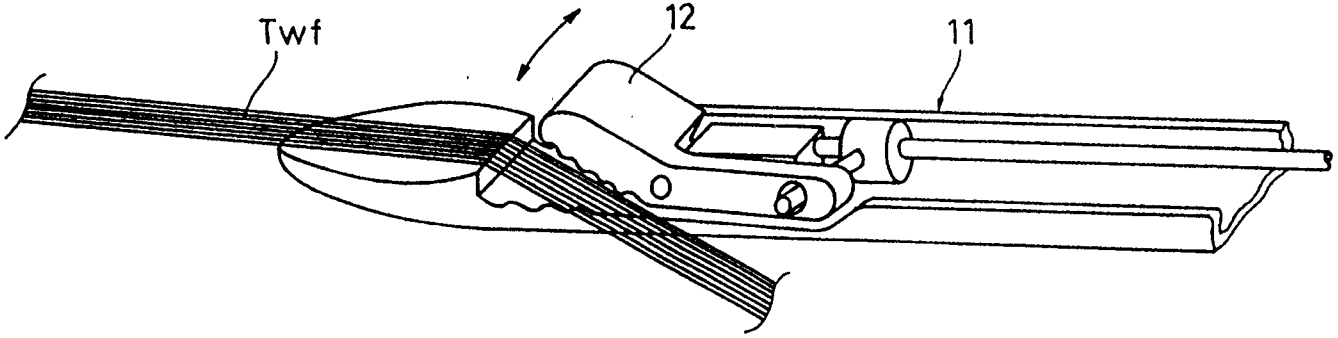
FIG. 6 is a perspective view which shows another mode wherein weft is held by the rapier.

To grasp the flat weft $T_{wf}$ by the rapier 11, the end of the weft $T_{wf}$ led to the tip of the rapier 11 is grasped by a clamping tool 12 as shown in FIG. 6. This makes it possible to insert the weft $T_{wf}$ while keeping its flatness almost unimpaired.

In the weaving apparatus for CF fabric according to the present invention, the weft $T_{wf}$ wound around the bobbin 1 is paid out at a constant speed by the draw-off roller 3 during the weft supply process performed by the weft supply unit described above, and the slack which takes place when the weft $T_{wf}$ is inserted intermittently by the rapier 11 is absorbed by the spring 4*b* of the tension device 4.

Then, the weft $T_{wf}$, which has been taken out transversely from the bobbin 1, is guided by the guide rollers 5 through 7 and hooked onto the hook 11a of the rapier 11 by the cooperation of the presser plate guide 9 and the yarn end holding guide 10 while the tension of the weft $T_{wf}$ being kept uniform by the leaf spring tension device 8, then it is inserted between the multiple warps $T_{wr}$ shown in FIG. 1.

Thus, the weft $T_{wf}$ consisting of CF yarn can be woven in without being twisted or incurring damage to its flatness.

The warp supply unit will now be described. The creel 20 supports many bobbins 20*a* in a manner that they are free to rotate. Just as the bobbin 1 of the weft supply unit, each bobbin 20*a* is wound with warp $T_{wr}$ consisting of CF yarn. The warp $T_{wr}$ is paid out transversely and led to the cloth fell through the comb 21, the horizontal guide 22, the heald 23, and the reed 24.

In this case, the speed at which the warp $T_{wr}$ is paid out from a bobbin 20*a* is extremely lower than that for the weft $T_{wf}$ and it is a constant speed; therefore, the bobbin 20*a* is equipped with just a light brake.

The comb 21 consists of a plurality of wires 21*b* which are provided vertically between the top and bottom support frames 21*a* and 21*a* at the same intervals as those for the warps $T_{wr}$ of fabric. The multiple warps $T_{wr}$ are passed between the wires 21*b* and 21*b* one by one so that they are positioned with respect to the horizontal direction, thus combing the warps $T_{wr}$ at the desired density.

In this case, it is necessary to set the wires 21*b* to a specified length so that the flat warps $T_{wr}$ supplied from the bobbins 20*a* of the creel 20 do not touch the support frames 21*a* and 21*a* but the flat surfaces of the warp $T_{wr}$ touch only the wires 21*b*. If the wires 21*b* are shorter than the specified length, then the warps $T_{wr}$ will be squeezed. The optimum length of the wires 21*b* is determined by the height of the creel 20 and the distances from the creel 20 to the comb 21 and to the horizontal guide 22, however, it needs to be about 300 mm.

The horizontal guide 22 has two guide bars 22*a* and it winds the warps $T_{wr}$, which have been taken out from the bobbins 20*a*, onto the two guide bars 22*a* in an S shape to restrict the vertical position.

It is now necessary to twist the flat surfaces of the warps $T_{wr}$ 90 degrees between the comb 21 and horizontal guide 22. For this purpose, the comb 21 must be spaced away from the horizontal guide 22 by at least 50 mm although the distance varies depending on the width of the warps $T_{wr}$. If the distance between the comb 21 and the horizontal guide 22 is less than 50 mm, then the warps $T_{wr}$ will be passed through the horizontal guide 22 and woven in while it is kept in a twisted state.

The healds 23 are provided one each for each warp $T_{wr}$ and they guide the individual warps $T_{wr}$, which have been vertically positioned by the horizontal guide 22, to the reed 24. The healds 23 are moved up and down by a driving means not shown, thus forming a shuttle path for passing the weft $T_{wf}$ between the multiple warps $T_{wr}$ on the downstream side of the reed 24.

In the conventional heald, the mail is made longer longitudinally to minimize the interference at between the adjoining yarn and the heald. However, passing the CF fiber through such a mail, which is longer longitudinally, crushes the flatness, preventing weaving to be performed with the flatness maintained. For this reason, it is desirable that the mail 23*a* of the heald 23 is formed so that it is longer laterally, and the lateral length of the mail 23*a* needs to be set at the same length as or slightly longer than the yarn width of the CF yarn used as the warp $T_{wr}$. The shape of the mail 23*a* should be rectangular or an ellipse which is long horizontally.

The reed 24 functions to arrange the multiple warps $T_{wr}$ paid out from the multiple bobbins 20*a* mounted on the creel 20 to a specified density and to press the weft $T_{wf}$, which has been passed into the shuttle path, against the cloth fell. The frame 24*a* has many dents 24*b* arranged vertically. As shown in FIG. 2 and FIG. 3, the reed 24 is shuttled in the running direction of the warps $T_{wr}$ shown by the arrowhead in FIG. 3 by a cam 28 to which the rotation of a driving motor 25 is transmitted, thereby pressing the weft $T_{wf}$ against the cloth fell.

In this case, the tension of the warps $T_{wr}$ should be set as low as possible. The low tension of the warp $T_{wr}$ will prevent the flatness from being crushed even if the lateral position of the reed 24 is slightly dislocated, causing the warp $T_{wr}$ guided by the heald 23 to touch the dents 24*b* or even if the heald 23 shakes and the warp $T_{wr}$ is dislocated and moved to one side of the mail 23*a*.

In the warp supply unit described above, the warps $T_{wr}$ are combed to the desired density according to the following steps and the weft $T_{wf}$ fed by the weft supply unit is pressed against the cloth fell, thus weaving the CF fabric.

First, the warps $T_{wr}$ are paid out from all the multiple bobbins 20*a* mounted on the creel 20.

The individual warps $T_{wr}$ are positioned horizontally by the comb 21 then twisted 90 degrees before they are led to the horizontal guide 22.

The multiple warps $T_{wr}$ led to the horizontal guide 22 are positioned vertically by the guide bars 22*a* and 22*a*, then they are guided to the healds 23, which are moved up and down by the driving means not shown, every other warp, thereby forming the shuttle path for inserting the weft $T_{wf}$ between the multiple warps $T_{wr}$ on the downstream side of the reed 24.

The multiple warps $T_{wr}$ paid out from the multiple bobbins 20*a* mounted on the creel 20 are arranged by the reed 24 to a specified density and guided to the cloth fell.

When the shuttle path is formed by the healds 23, the weft $T_{wf}$ is inserted between the multiple warps $T_{wr}$ by the intermittent operation of the rapier 11, and the inserted weft $T_{wf}$ is pressed against the cloth fell by the reed 24. Thus, the CF fabric is woven a shown in FIG. 1.

This warp supply process forms all warps $T_{wr}$ into a sheet-like shape in which they are arranged equidistantly, permitting stable weaving.

Figure 7:
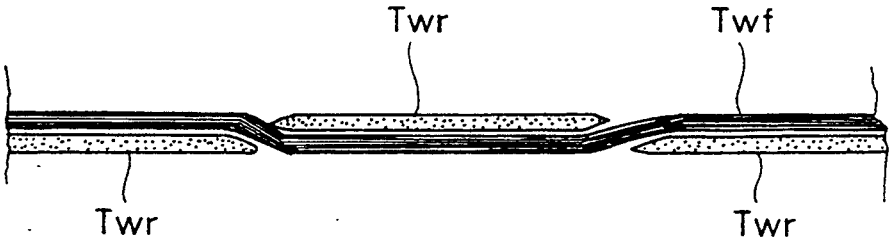
FIG. 7 is a cross-sectional view of the CF fabric according to the present invention which is woven using warp and weft consisting of a single flat CF yarn.

Thus, in the weaving method and weaving apparatus for the CF yarn according to the present invention, the warp and weft made of flat CF yarn of a large yarn size are woven, with their flatness maintained, into a thin CF fabric with a uniform fiber density. As shown in FIG. 7, almost no crimps were observed at the portions where the warps $T_{wr}$ cross the weft $T_{wf}$.

FIG. 7 shows an enlarged view of the cross section of the woven CF fabric. It exaggerates the CF yarns presenting the warps and weft to serve as a model.

Further, the following describes how a CF fabric is woven with warps and weft consisting of a plurality of layers of flat unit CF yarn.

Two or three bobbins 1 are prepared for the weft, the weft $T_{wf}$ paid out from each bobbin 1 being taken as the unit CF yarn. The two or three wefts $T_{wf}$ are guided to the draw-off roller 3 in a manner that they are piled on top of each other on the draw-off roller 3, then they go through the tension device 4 and the leaf spring tension device 8.

By inserting the laminated wefts $T_{wf}$ between the multiple warps $T_{wr}$ by the rapier 11, the laminated wefts $T_{wf}$ can be inserted between the multiple warps $T_{wr}$ without causing the flatness of the laminated weft $T_{wf}$ to be crushed.

For the warps, the warps $T_{wr}$ paid out from two or three bobbins 20*a* are piled on top of each other as the unit CF yarns. The laminated warps $T_{wr}$ are passed between the wires 21*b* and 21*b* of the comb 21, then guided to between the dents 24*b* and 24*b* of the reed 24 via the horizontal guide 22 and the healds 23.

Thus, in the weaving method and weaving apparatus for the CF yarn according to the present invention, a CF fabric woven with the wefts $T_{wf}$ and warps $T_{wr}$ consisting of laminated unit CF yarns will be obtained.

Figure 8:
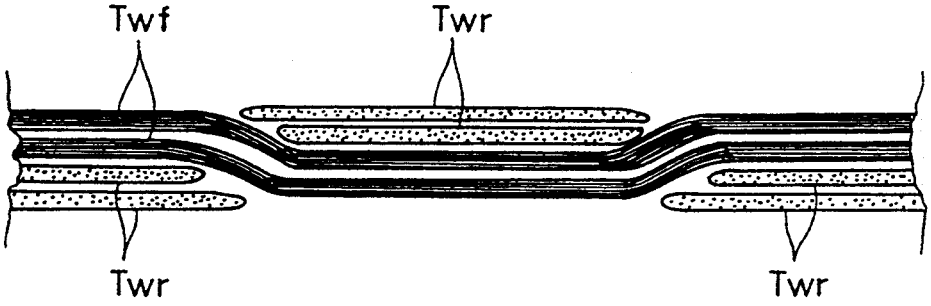
FIG. 8 is a cross-sectional view of the CF fabric according to the present invention which has been woven using warp and weft consisting of two flat unit CF yarns formed in layers.

The CF fabric thus woven with the wefts $T_{wf}$ and the warps $T_{wr}$ consisting of two layered unit CF yarns shows a uniform fiber density but hardly shows crimps at the portions where the warps $T_{wr}$ and the wefts $T_{wf}$ cross each other as shown in FIG. 8.

FIG. 8 shows an enlarged view of the cross section of the woven CF fabric and the CF yarns presenting the warps and weft are exaggerated as in FIG. 7.

Based on the weaving methods described above, the following explains about embodiments related to the CF fabric woven using the aforesaid weaving apparatus.

EXAMPLE 1

The CF fabric according to the present invention was woven by the weaving method and weaving apparatus according to the present invention with the main rotary shaft 26 running at a speed of 120 rpm, using a flat CF yarn, which is 6.5 mm in width and 0.12 mm in thickness and whose shape is maintained by applying 0.8% of a sizing agent, the flat CF yarn consisting of a twist-free CF yarn [TORAYCA T700SC-12K (the number of carbon fibers: 12,000; yarn size: 7,200 deniers)] made by Toray Industries, Inc. and having a tensile break strength of 500 kg·f/mm$^2$, a tensile modulus of 23,500 kg·f/mm$^2$, and a tensile break elongation of 2.1%.

The obtained CF fabric is a plain weave, the density of the warps and wefts being 1.25 ends/cm, the yarn width of the warp and weft being 7.6 mm, the yarn thickness being 0.11 mm, the ratio of the yarn width to the yarn thickness being 69.1, the ratio of the weaving yarn pitch between warps and wefts to the yarn width being 1.05, the fabric thickness being 0.22 mm, the weight of woven fabric being 200 g/m$^2$, and the fiber density being 0.91 g/cm$^3$.

The warps and wefts of the CF fabric are free of take-out twists and have a cover factor is 99.8%, meaning that there is almost no gaps. Thus, the CF fabric has a uniform fiber density and smooth surface.

Moreover, the weaving yarn density of the CF fabric is $\frac{1}{4}$ of that of the conventional CF fabric which is a plain weave made of a similar CF yarn [TORAYCA T300B-3K (the number of carbon fibers: 3,000; yarn size: 1,800 deniers)] made by Toray Industries, Inc. and which has a warp and weft density of 5.0 ends/cm, and a weight of woven fabric of 200 g/m$^2$. Therefore, the weaving speed for the CF fabric is four times as fast as that for the conventional fabric, resulting in significantly improved productivity.

Next, the obtained CF fabric was infiltrated with 36 percentage by weight of an epoxy resin having a tensile break elongation of 3.5% to produce a prepreg. The prepreg exhibited a smooth surface just like the CF fabric and uniformly distributed carbon fibers.

Then, the prepreg was laid up in four plies in the same orientation to make a CFRP by the autoclave molding method. The tensile break strength and the tensile modulus of the CFRP were measured in accordance with the CFRP tensile testing method of ASTM D3039.

The results are shown in Table 1 which also gives the volume content of the carbon fiber. During the measurement, the CFRP broke at 1.6% elongation of the CF yarn, however, it did not develop microcracks in the matrix resin in the transverse direction which crosses the tensile direction at right angle.

TABLE 1

| Description | Ex. 1 | Com. 1-1 | Com.1-2 |
|---|---|---|---|
| CF Volume Content (%) | 55 | *55 | 55 |
| Tensile B. Strength (kg · f/mm$^2$) | 107.2 | *82.6 | 91.5 |
| Tensile modulus (kg · f/mm$^2$) | 6800 | *6500 | 6800 |

Ex.: Example
Com.: Comparative Example
Tensile B. Strength: Tensile break strength

COMPARATIVE EXAMPLE 1—1

For the purpose of comparison, the CF yarn of Example 1 was used to weave a plain-weave CF fabric at a warp and weft density of 1.25 ends/cm using a known single-sided rapier loom according to a conventional weaving method wherein the weft is taken out longitudinally and the multiple warps are taken out transversely, then the individual warps are guided in sequence to the round hole guide of the warp creel, the arranging guide, and the healds having mails which are long vertically.

The warps of the resulting fabric are woven squeezed with their flatness destroyed. The weft was squeezed with three to four take-out twists per meter, and the cover factor was 85.0% which means an extremely coarse texture, the fabric surface displaying irregularities. In the woven fabric, the yarn width of the warps and weft was 4.9 mm, the ratio of the yarn width to the yarn thickness 28.8, the ratio of the weaving pitch to yarn width 1.63, the fabric thickness 0.34 mm, the weight of woven fabric 200 g/m$^2$, and the fiber density of 0.59 g/cm$^3$.

The fabric was infiltrated with an epoxy resin having a tensile break elongation of 3.5% in the same manner as in Example 1 to make a prepreg. At this time, the resin in the gaps in the fabric was taken off and lost by a mold release film; therefore, resin had to be added to fill the lost portion.

The prepreg thus produced was laid up in four plies in the same orientation to make a CFRP by the autoclave molding method as in Example 1.

The obtained CFRP had an uneven surface with depressions at the gaps in the fabric and many voids were observed.

The tensile break strength and the tensile modulus of the CFRP were measured according to the testing method used for Example 1. The results are shown in Table 1 which also indicates the carbon fiber volume content.

The actual measurement of the carbon fiber volume content of the acquired CFRP was 44%; therefore, Table 1 shows the values obtained by converting the carbon fiber volume content to 55%.

As it is obvious from the results given in Table 1, the CFRP made of the CF fabric according to the present invention provides extremely high tensile break strength and also high tensile modulus which are unthinkable with conventional CF base fabric.

In contrast with the above-mentioned CFRP, the CFRP of Comparative Example 1—1 uses a reinforcing base fabric which has a low fiber density, 0.60 g/cm$^3$; therefore, the carbon fiber volume content is accordingly low and the matrix resin unevenly exists in the gaps in the fabric, causing cracks to occur. As it is obvious from the results of Comparative Example 1—1, this CFRP has a lower tensile break strength than that of the CFRP of Example 1.

COMPARATIVE EXAMPLE 1-2

The CF fabric according to the present invention shown in Example 1 was woven, and the fabric was infiltrated with an epoxy resin with a 1.7% tensile break elongation to make prepregs, then a CFRP was made in the same manner as in Example 1.

The tensile break strength and the tensile modulus of the CFRP were measured according to the testing method used for Example 1. The results are shown in Table 1 which also indicates the carbon fiber volume content.

Since the CFRP has the low matrix tensile break elongation, 1.7%, microcracks took place early in the lateral direction which crosses with the pulling direction. As it is seen from Table 1, the tensile break strength of the CFRP is lower than that of Example 1.

EXAMPLE 2

Using the CF yarn shown in Example 1, the CF fabric according to the present invention was woven by the weaving method and weaving apparatus according to the present invention. The fabric was infiltrated with a vinyl ester resin (RIPOXY, R804 made by SHOWA HIGHPOLYMER CO., LTD.) by hand lay-up, and four plies of the fabric were layered and cured at room temperature (25° C.) to produce a CFRP.

Despite that the CFRP was produced by the hand lay-up molding, it exhibited a high carbon fiber volume content, 45%, and was infiltrated thoroughly with the resin and free of voids. This was made possible by the high fiber density, 0.91 g/cm$^3$ of the woven CF fabric.

The tensile break strength and the tensile modulus of the CFRP thus acquired were measured according to the testing method used for Example 1. As shown in Table 2, the strength of the CFRP proved to be as high as that of the CFRP which was obtained by the autoclave molding method in Example 1.

The retention of the tensile strength shown in Table 2 refers to a percentage of actual measurements to the theoretical strength values calculated from the strength of CF.

TABLE 2

| Description | Ex. 2 | Com. 2 |
|---|---|---|
| CF volume content (%) | 45.4 | 32.1 |
| Tensile B. strength (kg · f/mm$^2$) | 97.2 | 32.3 |
| Tensile modulus (kg · f/mm$^2$) | 5400 | 3700 |
| Retention of tensile strength(%) | 85.6 | 55.9 |

Ex.: Example
Com.: Comparative Example
Tensile B. strength: Tensile break strength

COMPARATIVE EXAMPLE 2

A CF fabric was woven by the conventional weaving method shown in Comparative Example 1—1, using a flat CF yarn, which is 2 mm in width and 0.1 mm in thickness and whose shape is maintained by applying 1.0% of a sizing agent, the flat CF yarn consisting of a CF yarn [TORAYCA T300B-3K (the number of carbon fibers: 3,000; yarn size: 1,800 deniers)] made by Toray Industries, Inc. and having a tensile break strength of 360 kg·f/mm$^2$, a tensile modulus of 23,500 kg·f/mm$^2$ and a tensile break elongation of 1.5%.

The obtained CF fabric was a plain weave, the density of the warps and wefts being 5.0 ends/cm, the yarn width of the warp and weft being 1.6 mm, the yarn thickness being 0.13 mm, the ratio of the yarn width to the yarn thickness being 12.3, the ratio of the weaving yarn pitch to the yarn width being 1.25, the woven fabric thickness being 0.27 mm, the weight of woven fabric being 200 g/m$^2$, and the fiber density being 0.74 g/cm$^3$.

As in Example 2, the woven fabric was infiltrated with the aforesaid vinyl ester resin by hand lay-up, and the woven fabric was layered in four plies then cured at room temperature (25° C.) to produce a CFRP. The resulting CFRP exhibited a normal value of carbon fiber volume content, 32.1%, and good resin infiltration property.

The tensile break strength and the tensile modulus of the CFRP were measured according to the testing method in Example 1. The results are shown in Table 2 which also indicates the carbon fiber volume content and the retention of the tensile strength.

The CF fabric of Comparative Example 2 presents no problem with the resin infiltration property, and it was different from the CF fabric in Example 2 only in the CF yarn used. As shown in Table 2, however, the tensile break strength of the CFRP in Comparative Example 2 was extremely low compared with the CFRP of Example 2. This result can be understood from the retention of the tensile strength which crimps of weaving CF yarns contribute to the strength of the CFRP.

While the fiber density of the CF fabric of the CFRP in Comparative Example 2 was 0.74 g/cm$^3$, the CF fabric used for the CFRP in Example 2 had a high fiber density, 0.91 g/cm$^3$ and therefore the carbon fiber volume content in the CFRP was accordingly higher, and also the CF fabric in Example 2 had smaller crimps of weaving yarn, resulting in high strength.

Figure 9:
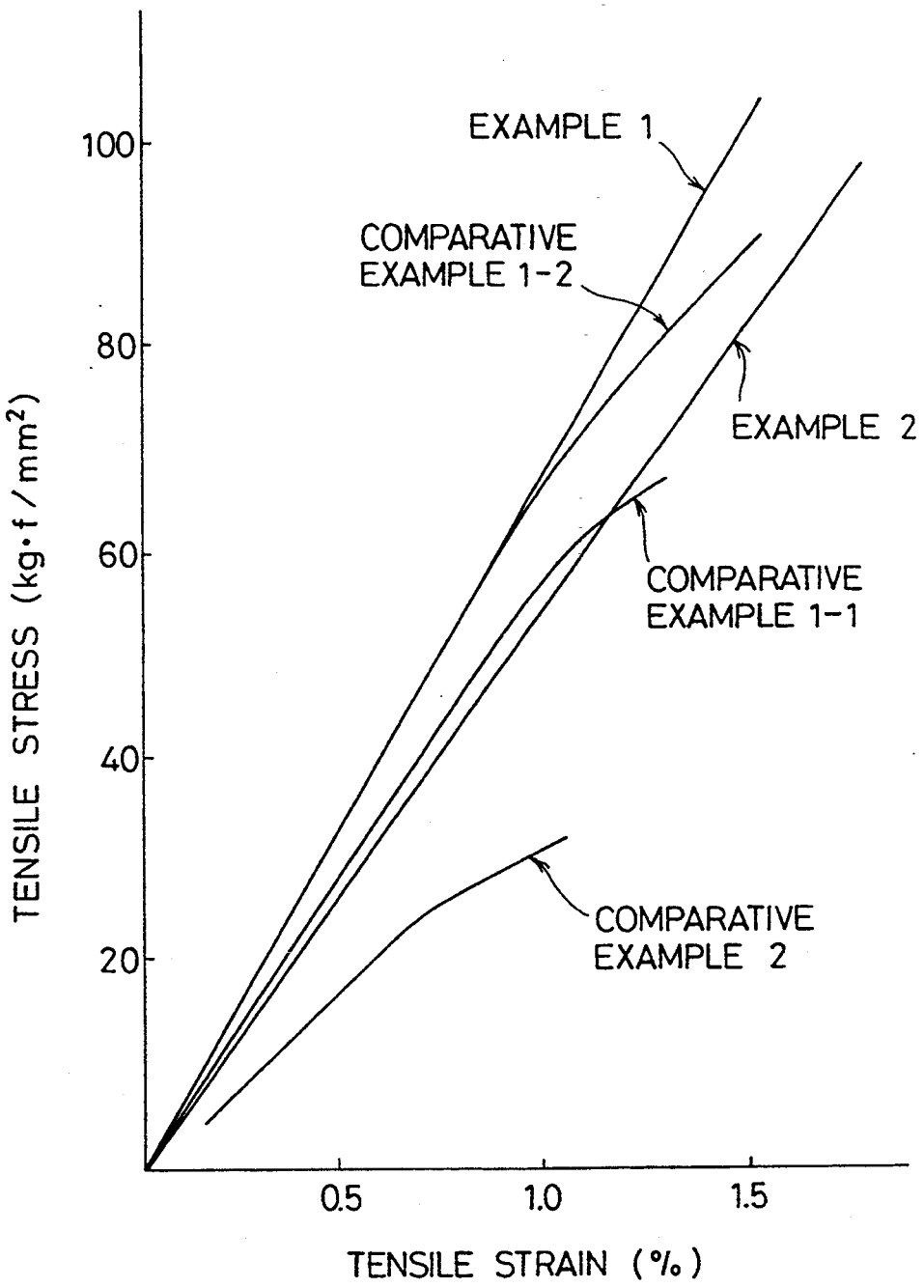
FIG. 9 is a tensile strength characteristic diagram related to the stress-strain curve of a CFRP which is made of the CF fabric according to the present invention.

Based on the tensile test in Examples 1 and 2, Comparative Examples 1—1, 1-2, and Comparative Example 2, the strength characteristic diagram shown in FIG. 9 was drawn, taking the tensile strain (%) on the X-axis and the tensile stress (kg·f/mm$^2$) on the Y-axis.

As it is obvious from FIG. 9, decline is observed in the tensile modulus preceding the break strain which is considered due to the occurrence of cracks that started with a gap having much matrix resin in the CFRP of Comparative Example 1—1 or due to the occurrence of microcracks in the lateral direction which crosses with the pulling direction at right angle in the CFRP of Comparative Example 1-2.

Also in the CFRP of Comparative Example 2, the changing rate of the tensile modulus started to drop around a tensile strain of 0.6%. This is presumed attributable to the crimps of the CF yarn used being stretched and the infiltrated resin could no longer support the CF yarn. This presumption is based on the cracks which were observed in the resin of the CFRP of Comparative Example 2.

Hence, when using this CFRP as a structural material, it is dangerous to attempt to depend on the tensile break strength. It is necessary to take a lower tensile break strength as a basis.

The CF fabric according to the present invention was woven by the weaving method and weaving apparatus according to the present invention, using a flat CF yarn, which is 6.5 mm in width and 0.12 mm in thickness and whose shape is maintained by applying 0.8% of a sizing agent, the flat CF yarn consisting of a twist-free CF yarn [TORAYCA T700SC-12K (the number of carbon fibers: 12,000; yarn size: 7,200 deniers)] made by Toray Industries, Inc. and having a tensile break strength of 500 kg·f/mm$^2$, a tensile modulus of 23,500 kg·f/mm$^2$, and a tensile break elongation of 2.1% as the warp, and a glass fiber yarn [ECE225-½ (the number of fibers: 460; yarn size: 405 deniers) made by Nitto Boseki Co., Ltd.] as the auxiliary yarn for the weft.

The obtained CF fabric is a unidirectional plain weave, the density of the warp being 1.25 ends/cm, the density of the weft being 2.5 ends/cm, the yarn width of the warp being 7.8 mm, the warp thickness being 0.1 mm, the ratio of the yarn width to the yarn thickness of the warp being 78, the ratio of the weaving yarn pitch to the yarn width of the warp being 1.03, the fabric thickness being 0.11 mm, the weight of woven fabric being 111 g/m$^2$, and the fiber density being 1.01 g/cm$^3$.

The CF fabric was a thin fabric which had a uniform fiber density and had no gaps between adjacent warps.

The fabric was infiltrated with the vinyl ester resin in Example 2 by hand lay-up, and four plies of the resulting fabric were layered in the same orientation, then cured at room temperature (25° C.) to produce a CFRP.

The tensile break strength of the CFRP in the direction of the CF fiber orientation was evaluated according to the test method used in Example 1. The results are shown in Table 3 which also gives the carbon fiber volume content and the tensile modulus.

The obtained CFRP exhibited high carbon fiber content and high tensile break strength despite that it was produced by the hand lay-up molding.

COMPARATIVE EXAMPLE 3

A plain weave unidirectional CF fabric was woven according to the conventional weaving method described in Comparative Example 1—1, using a CF yarn for the warp (warp yarn density: 1.25 ends/cm) and a glass fiber yarn (auxiliary yarn) for the weft (weft yarn density: 2.5 ends/cm) respectively in Example 3.

The obtained CF fabric had an extremely coarse texture with gaps between warps, the warp width being 5.0 mm, the warp thickness being 0.15 mm, the ratio of the yarn width to the yarn thickness of the warp being 33, the ratio of the weaving pitch to the yarn width of the warp being 1.60, the fabric thickness being 0.16 mm, the weight of woven fabric being 111 g/m$^2$, and the fiber density being 0.69 g/cm$^3$.

This fabric was used to make a CFRP by the hand lay-up molding described in Example 3, and the tensile break strength was evaluated according to the test method in Example 1. The results are shown in Table 3.

TABLE 3

| Description | Ex. 3 | Com. 3 |
|---|---|---|
| CF volume content (%) | 56.0 | 33.5 |

TABLE 3-continued

| Description | Ex. 3 | Com. 3 |
|---|---|---|
| Tensile B. strength (kg · f/mm$^2$) | 245.4 | 104.9 |
| Tensile modulus (kg · f/mm$^2$) | 12600 | 7600 |

Ex.: Example
Com.: Comparative Example
Tensile B. strength: Tensile break strength As it is obvious from Table 3, the carbon fiber volume content and the tensile break strength of the CFRP of Comparative Example 3 were about 34% and about 105 kg·f/mm$^2$, respectively, which were both lower than those of the CFRP of Example 3.

Observation of the CFRP of Example 3 revealed that its resin had been uniformly infiltrated in the CF fabric with almost no voids in contrast to the CFRP of Comparative Example 3.

EXAMPLES 4–8

CF fabrics were woven by the weaving method and weaving apparatus according to the present invention, using the twist-free CF yarn (TORAYCA T700SC made by Toray Industries, Inc.) used in Example 1 but using different numbers of fibers, different yarn widths and different sizes of yarn. Table 4 shows the CF yarns used, the specifications of the woven fabrics, and the woven fabric characteristics of the obtained CF fabrics.

Then, each of the CF fabrics was infiltrated with 36 percentage by weight of an epoxy resin having a tensile break elongation of 3.5% to produce prepregs. Four plies of each prepreg were layered in the same orientation and CFRPs were produced by the autoclave molding method. The tensile break strength and the tensile modulus of all the CFRPs were measured in accordance with the CFRP tensile

TABLE 4

| Description | Ex. 4 | EX. 5 | Ex.6 | Ex. 7 | Ex.8 | Com. 4 |
|---|---|---|---|---|---|---|
| CF Yarn | | | | | | |
| No. of fibers | 6,000 | 6,000 | 12,000 | 12,000 | 24,000 | 6,000 |
| Yarn width (mm) | 6.5 | 6.5 | 12 | 6.5 | 16 | 6.5 |
| Twist | None | None | None | None | None | None |
| Size | 3,600 | 3,600 | 7,200 | 7,200 | 14,400 | 3,600 |
| Fabric Spec. | | | | | | |
| Take-out twist | None | None | None | None | None | None |
| Yarn width (mm) | | | | | | |
| Warp | 7.8 | 4.8 | 10.9 | 5.1 | 14.5 | 7.9 |
| Weft | 6.7 | 4.8 | 10.1 | 5.1 | 13.8 | 6.7 |
| Yarn W/T ratio | | | | | | |
| Warp | 122 | 51 | 145 | 32 | 145 | 132 |
| Weft | 120 | 51 | 135 | 32 | 125 | 113 |
| WY pitch/YW ratio | | | | | | |
| Warp | 1.03 | 1.04 | 1.05 | 1.04 | 1.10 | 1.26 |
| Weft | 1.19 | 1.04 | 1.13 | 1.04 | 1.16 | 1.49 |
| Weight (g/m$^2$) | 100 | 160 | 140 | 300 | 200 | 80 |
| Fabric T. (mm) | 0.12 | 0.19 | 0.15 | 0.32 | 0.21 | 0.13 |
| Fiber D. (g/cm$^3$) | 0.83 | 0.84 | 0.93 | 0.94 | 0.95 | 0.62 |
| Characteristics | | | | | | |
| Cover factor (%) | 99.6 | 99.8 | 99.5 | 99.9 | 99.8 | 93.1 |
| Surface smoothness | Good | Good | Good | Good | Good | Bad |

| Description | Com. 5 | Com. 6 | Com. 7 | Com. 8 |
|---|---|---|---|---|
| CF Yarn | | | | |
| No. of fibers | 6,000 | 12,000 | 12,000 | 24,000 |
| Yarn width (mm) | 6.5 | 12 | 6.5 | 16 |
| Twist | None | None | None | None |
| Size | 3,600 | 7,200 | 7,200 | 14,400 |
| Fabric Spec. | | | | |
| Take-out twist | None | None | None | None |
| Yarn width (mm) | | | | |
| Warp | 2.5 | 11.0 | 3.8 | 7.6 |
| Weft | 2.4 | 10.2 | 3.8 | 7.6 |
| Yarn W/T ratio | | | | |
| Warp | 16 | 73 | 21 | 37 |
| Weft | 15 | 73 | 21 | 37 |
| WY pitch/YW ratio | | | | |
| Warp | 1.11 | 1.45 | 1.05 | 1.05 |
| Weft | 1.16 | 1.57 | 1.05 | 1.05 |
| Weight (g/m$^2$) | 300 | 100 | 400 | 400 |
| Fabric T. (mm) | 0.31 | 0.14 | 0.36 | 0.41 |
| Fiber D. (g/cm$^3$) | 0.97 | 0.71 | 1.11 | 0.98 |
| Characteristics | | | | |
| Cover factor (%) | 99.3 | 88.7 | 99.8 | 99.8 |
| Surface smoothness | Slightly bad | Bad | Slightly bad | Slightly bad |

Yarn W/T ratio: Yarn width/thickness ratio
WY pitch/YW ratio: Ratio of weaving yarn pitch to yarn width
Fabric T.: Fabric thickness
Fiber D.: Fiber density

TABLE 5

| | Ex. 4 | EX. 5 | Ex.6 | Ex. 7 | Ex.8 | Com. 4 |
|---|---|---|---|---|---|---|

TABLE 5-continued

| | | | | | | |
|---|---|---|---|---|---|---|
| CF volume content(%) | 55.0 | 54.2 | 55.8 | 54.0 | 54.1 | 42.0 |
| Tensile B. strength (kg · f/mm$^2$) | 103.1 | 97.6 | 110.2 | 105.1 | 101.5 | 73.5 |
| Tensile modulus (kg · f/mm$^2$) | 6,800 | 6,750 | 6,850 | 6,800 | 6,750 | 5,300 |
| Surface smoothness | Good | Good | Good | Good | Good | Bad |
| Void rate (%) | 0.9 | 1.0 | 0.5 | 0.6 | 0.5 | 2.8 |

| | Com. 5 | Com. 6 | Com. 7 | Com. 8 |
|---|---|---|---|---|
| CF volume content(%) | 54.0 | 45.0 | 55.0 | 53.0 |
| Tensile B. strength (kg · f/mm$^2$) | 79.8 | 74.8 | 75.5 | 80.1 |
| Tensile modulus (kg · f/mm$^2$) | 6,600 | 5,500 | 6,650 | 6,550 |
| Surface smoothness | Slightly bad | Bad | Bad | Bad |
| Void rate (%) | 4.0 | 2.9 | 5.1 | 4.5 |

test method of ASTM D3039.

The results are shown in Table 5 which also gives the carbon fiber volume content, surface smoothness, and void rate.

COMPARATIVE EXAMPLES 4–8

For the purpose of comparison, using the same CF yarn used for Examples 4 through 8, five types of CF fabrics which differ in yarn width, ratio of yarn width to yarn thickness, ratio of weaving pitch to yarn width, weight of woven fabric, fabric thickness, and fiber density. Table 4 shows the specifications and characteristics of these CF fabrics.

Then, each of the CF fabrics was infiltrated with 36 percentage by weight of an epoxy resin having a tensile break elongation of 3.5% to produce prepregs. Four plies of each prepreg were layered in the same orientation and CFRPs were produced by the autoclave molding method. The tensile break strength and the tensile modulus of all the CFRPs were measured in accordance with the CFRP tensile test method of ASTM D 3039. The results are shown in Table 5 which also gives the carbon fiber volume content, surface smoothness, and void rate.

As it is obvious from Table 4, the CF fabrics of Examples 4 through 8 have higher cover factors and smoother fabric surfaces on the average than the CF fabrics of Comparative Examples 4 through 8.

The CF fabrics of Comparative Examples 4 and 6 were woven by the weaving method and weaving apparatus according to the present invention in a manner that the flatness of the CF yarn would not be crushed. However, the weight of woven fabric and fabric thickness were extremely small for the yarn size of the CF yarn used, and therefore, the gaps between the warp and weft were large with a resultant small cover factor.

In addition, the CFRPs using the CF fabrics in Comparative Examples 4 and 6 have larger gaps between warp and weft than those in the CFRPs using the CF fabrics in Examples 4 through 8; therefore, they exhibited lower tensile break strength and tensile modulus as shown in Table 5.

The weight of woven fabric and fabric thickness of the CF fabrics of Comparative Examples 5, 7, and 8 were extremely large for the yarn size of the CF yarn used, and therefore, the CF fabrics had a high cover factor and fiber density but exhibited poor smoothness and they were too thick as it is obvious from Table 4.

Hence, as it is obvious from Table 5, the CFRPs using the CF fabrics in Comparative Examples 5, 7, and 8 exhibited poor surface smoothness and a high void rate; therefore, their tensile break strength and tensile modulus were lower than those of the CFRPs which used the CF fabrics in Examples 4 through 8.

EXAMPLE 9

A CF fabric was woven by the weaving method according to the present invention, using the flat, twist-free CF yarn (the number of carbon fibers: 12,000; yarn size: 7,200 deniers; yarn width: 6.5 mm; yarn thickness: 0.12 mm), which was used in Example 1, as the unit CF yarn, the unit CF yarns being taken out by the draw-off roller 3 of the weft supply unit from two bobbins 1, which are installed beforehand, and the two yarns being layered to provide the weft, and the unit CF yarns being taken out from two bobbins 20*a* of the warp supply unit and the two yarns being layered to provide the warp in the weaving apparatus, and the density of the warp and weft being 1.56 ends/cm.

The CF yarn used, fabric specifications and fabric characteristics of the obtained CF fabric are shown in Table 6 below.

Then, each of the CF fabric thus produced was infiltrated with 36 percentage by weight of an epoxy resin having a tensile break elongation of 3.5% to produce prepregs as in Examples 4 through 8. Four plies of each prepreg were layered in the same orientation and CFRPs were produced by the autoclave molding method. The tensile break strength and the tensile modulus of all the CFRPs were measured in accordance with the CFRP tensile test

TABLE 6

| Description | Example 9 | Comparative Example 9 |
|---|---|---|
| CF Yarn | | |
| No. of fibers | 12,000 | 12,000 |
| Yarn width (mm) | 6.5 | 6.5 |
| Twist | None | None |
| Size of yarn | 7,200 | 7,200 |
| Specification of Woven Fabric | | |
| Take-out twist | None | None |
| No. of yarn layers | 2 | 1 |
| Yarn width (mm) | | |
| Warp | 6.1 | 3 |
| Weft | 6.0 | 3 |
| Yarn W/T ratio | | |
| Warp | 51 | 12 |
| Weft | 50 | 12 |
| WY pitch/YW ratio | | |
| Warp | 1.02 | 1.07 |
| Weft | 1.04 | 1.07 |
| Weight (g/m$^2$) | 500 | 500 |
| Fabric Thickness (mm) | 0.50 | 0.52 |
| Fiber D. (g/cm$^3$) | 1.00 | 0.97 |
| Characteristics | | |
| Cover factor (%) | 99.9 | 99.8 |
| Surface smoothness | Good | Slightly bad |

Yarn W/T ratio: Yarn width/thickness ratio
WY pitch/YW ratio: Ratio of weaving yarn pitch to yarn width
Fiber D.: Fiber density method of ASTM D3039.

The results are shown in Table 7 which also gives the carbon fiber volume content, surface smoothness, and void rate.

As it is obvious from Table 6, the CF fabric according to this example had a large weight of woven fabric and possible poor resin infiltration was concerned.

However, the CF yarns of the CF fabric of this

TABLE 7

| Description | Example 9 | Comparative Example 9 |
|---|---|---|
| CF volume content(%) | 54.2 | 54.8 |
| Tensile B. strength (kg · f /mm$^2$) | 97.1 | 72.5 |
| Tensile modulus (kg · f /mm$^2$) | 6,700 | 6,400 |
| Surface smoothness | Good | Bad |
| Void rate (%) | 0.9 | 3.6 |

example lie on top of one another flatly, and therefore, resin was fully infiltrated through the gaps between the flat CF yarns at the time of molding the prepreg, preventing large voids from occurring. The produced CFRP exhibited high tensile break strength as shown in Table 7.

COMPARATIVE EXAMPLE 9

For the purpose of comparison, a CF fabric was woven by the weaving apparatus and method according to the present invention, to obtain Comparative Example 9. In Comparative Example 9, the twist-free, flat unit CF yarn, which was used in Example 9, was not arranged in layers, and was woven in such a manner that the fabric was a plain weave with a warp and weft density of 3.13 ends/cm, the weight of woven fabric being the same 500 g/m$^3$ as that of the CF fabric obtained in Example 9, and the warp and weft being not twisted. The CF yarn used, fabric specifications, and fabric characteristics of the obtained CF fabric are shown in Table 6.

As shown in Table 6, the obtained fabric exhibited the same high cover factor as in Example 9, however, its weaving yarn pitch of the warp and weft was 3.2 mm ($=3\times1.07$) which is smaller than the weaving pitch of Example 9 (Warp: 6.2 mm$=6.1\times1.02$; Weft: 6.2 mm$=6.0\times1.04$) and therefore, the flat CF yarn was crushed widthwise, causing an uneven surface.

Using the CF fabric thus produced, a prepreg was made in the same manner as in Example 9 to produce a CFRP. The tensile break strength and the tensile modulus of the obtained CFRP were measured as in Example 9. The results are shown in Table 7 which also gives the carbon fiber volume content, surface smoothness, and void rate.

The CF fabric of this comparative example had a larger weight of woven fabric and it also had some portions where the gaps through which the matrix resin permeates were completely stopped. This led to poor resin infiltration in the manufacturing process of the prepreg.

For this reason, as shown in Table 7, the produced CFRP exhibited poor surface smoothness and a high void rate. Also, the tensile break strength and tensile modulus of the CFRP were lower than those of the CFRP which used the CF fabric of Example 9.

Accordingly, as it is obvious from the results of Example 9 and Comparative Example 9, the resin infiltration property does not deteriorate in the CF fabric woven with warp and weft made of layers of flat, twist-free unit CF yarn even if the weight of woven fabric is large.

What is claimed is:

1. A carbon fiber woven fabric which comprises a flat carbon fiber yarn consisting of many carbon fibers as at least its warp or weft, said flat carbon fiber yarn being twist-free and the number of carbon fibers thereof being 6,000 to 36,000, the yarn size from 3,000 to 30,000 deniers, the yarn width from 4 to 16 mm, the yarn thickness from 0.07 to 0.6 mm, and the ratio of yarn width to yarn thickness from 20 to 150, and said carbon fiber woven fabric using said flat carbon fiber yarn which has a yarn width ranging from 4 to 16 mm, a yarn thickness ranging from 0.07 to 0.6 mm, a ratio of yarn width to yarn thickness ranging from 20 to 150, a ratio of the weaving yarn pitch between the warps and between the wefts to said yarn width ranging from 1.0 to 1.2, a fabric thickness ranging from 0.1 to 0.6 mm, a weight of woven fabric ranging from 90 to 500 g/m$^2$, and a fiber density of woven fabric ranging from 0.8 to 1.2 g/cm$^3$.

2. The carbon fiber woven fabric according to claim 1, wherein said flat carbon fiber yarn has 6,000 to 24,000 carbon fibers, a yarn size of 3,000 to 20,000 deniers, and a thickness of 0.07 to 0.2 mm, and said carbon fiber woven fabric has a yarn thickness of 0.07 to 0.2 mm, a ratio of yarn width to yarn thickness of 30 to 150, a woven fabric thickness of 0.1 to 0.4 mm, and a weight of woven fabric of 100 to 300 g/m$^2$.

3. The carbon fiber woven fabric according to claim 1, wherein said flat carbon fiber yarn has 6,000 to 24,000 carbon fibers, a yarn size of 3,000 to 20,000 deniers, and a thickness of 0.07 to 0.2 mm, and said carbon fiber woven fabric is a unidirectional woven fabric and has a yarn thickness of 0.07 to 0.2 mm, a ratio of yarn width to yarn thickness of 30 to 150, a woven fabric thickness of 0.1 to 0.3 mm, and a weight of woven fabric of 90 to 200 g/m$^2$.

4. The carbon fiber woven fabric according to claim 1, wherein said flat carbon fiber yarn consists of a plurality of layers of flat, unit carbon fiber yarn, the number of the carbon fibers of the unit carbon fiber yarn ranging from 3,000 to 12,000, a yarn size ranging from 1,500 to 10,000 deniers, a yarn width ranging from 4 to 16 mm, a yarn thickness ranging from 0.07 to 0.2 mm, and a ratio of yarn width to yarn thickness ranging from 30 to 150, and said carbon fiber woven fabric has a yarn width ranging from 4 to 16 mm, a yarn thickness ranging from 0.07 to 0.6 mm, a ratio of the yarn width to the yarn thickness ranging from 20 to 100, a ratio of the weaving yarn pitch to the yarn width ranging from 1.0 to 1.2, a woven fabric thickness ranging from 0.2 to 0.6 mm, a weight of woven fabric ranging from 200 to 500 g/m$^2$, and a fiber density of woven fabric ranging from 0.8 to 1.2 g/cm$^3$.

5. The carbon fiber woven fabric according to claim 2, wherein said weight of woven fabric and the yarn size of said carbon fiber yarn satisfy the relationship given in the formula shown below and also the cover factor is in a range of 95 to 100%.

$$W=k\cdot D^{\frac{1}{2}}$$

where

W: Weight of woven fabric
k: Proportional constant (1.6 to 3.5)
D: Yarn size of the warp or weft which are carbon fiber yarn.

6. The carbon fiber woven fabric according to claim 3, wherein said weight of woven fabric and the yarn size of said carbon fiber yarn satisfy the relationship given in the formula shown below and also the cover factor is in a range of 95 to 100%.

$$W=k\cdot D^{\frac{1}{2}}$$

where
W: Weight of woven fabric
k: Proportional constant (0.9 to 2.0)
D: Yarn size of the warp or weft which are carbon fiber yarn.

7. The carbon fiber woven fabric according to claim 4, wherein said weight of woven fabric and the yarn size of said carbon fiber yarn consisting of a plurality of layers of unit carbon fiber yarns satisfy the relationship given in the formula shown below and also the cover factor is in a range of 95 to 100%.

$$W=k\cdot D^{\frac{1}{2}}$$

where
W: Weight of woven fabric
k: Proportional constant (2.0 to 4.2)
D: Yarn size of the carbon fiber yarn.

* * * * *